US009382879B2

(12) United States Patent
Matsunaga et al.

(10) Patent No.: US 9,382,879 B2
(45) Date of Patent: Jul. 5, 2016

(54) FUEL EVAPORATIVE GAS EMISSION SUPPRESSION SYSTEM

(71) Applicant: MITSUBISHI JIDOSHA KOGYO KABUSHIKI KAISHA, Tokyo (JP)

(72) Inventors: Hideo Matsunaga, Okazaki (JP); Hitoshi Kamura, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 98 days.

(21) Appl. No.: 14/527,192

(22) Filed: Oct. 29, 2014

(65) Prior Publication Data

US 2015/0114361 A1 Apr. 30, 2015

(30) Foreign Application Priority Data

Oct. 30, 2013 (JP) ..... 2013-225477
Oct. 30, 2013 (JP) ..... 2013-225478
Oct. 30, 2013 (JP) ..... 2013-225479

(51) Int. Cl.
*F02M 33/04* (2006.01)
*F02M 25/08* (2006.01)

(52) U.S. Cl.
CPC ..... *F02M 25/0836* (2013.01); *F02M 25/089* (2013.01); *F02M 25/0818* (2013.01)

(58) Field of Classification Search
CPC ..... F02M 25/0836; F02M 25/0818; F02M 25/089; F02M 25/0809; F02M 25/0854
USPC ..... 123/516, 518, 519, 520; 701/107, 112; 73/114.39
See application file for complete search history.

(56) References Cited

U.S. PATENT DOCUMENTS 6,988,396 B2 * 1/2006 Matsubara ..... F02M 25/089 73/114.38
7,036,359 B2 * 5/2006 Hayakawa ..... F02M 25/0809 73/114.39
7,536,251 B2 * 5/2009 Saito ..... B60W 10/26 123/480
2014/0116401 A1 * 5/2014 Horiba ..... F02M 25/0809 123/520

FOREIGN PATENT DOCUMENTS

JP 4352945 B2 10/2009

* cited by examiner

*Primary Examiner* — Hai Huynh
(74) *Attorney, Agent, or Firm* — Birch, Stewart, Kolasch & Birch, LLP

(57) ABSTRACT

If a pressure deviation ΔP (amount of pressure decrease) after a first predetermined time period T1 has elapsed since a bypass valve (canister opening/closing valve) is controlled from an opened to closed state by actuating a negative pressure pump when the engine is stopped and a purge valve is opened is less than a first predetermined pressure P1, it is determined that the bypass valve is in an open sticking state, and if the pressure deviation ΔP is not less than the first predetermined pressure P1, it is determined that the bypass valve is not in an open sticking state. Moreover, a pressure deviation ΔP after a second predetermined time T2 has elapsed since the bypass valve is subsequently controlled to be opened decreases by not less than a second predetermined pressure P2, it is determined that the bypass valve 37 is not in a closed sticking state.

14 Claims, 17 Drawing Sheets

FUEL EVAPORATIVE GAS EMISSION SUPPRESSION SYSTEM

BACKGROUND OF THE INVENTION

1. Field of the Invention

The present invention relates to a fuel evaporative gas emission suppression system, and particularly to a technique for detecting an abnormality of the fuel evaporative gas emission system.

2. Description of the Related Art

Conventionally, to prevent emission of fuel evaporative gas evaporated in a fuel tank into the atmosphere, there is provided a fuel evaporative gas emission suppression system comprising: a canister mounted in a communication path for communicating a fuel tank with an intake passage of an internal combustion engine; a changeover valve for releasing or blocking the canister to or from the atmosphere; a sealing valve for communicating or blocking between the fuel tank and the canister; and a purge valve for communicating and shutting off the communication path between the intake passage and the canister. The fuel evaporative gas emission suppression system opens the changeover valve and the sealing valve and closes the purge valve during fueling so as to make fuel evaporative gas in the fuel tank flow out into the canister, thereby causing the fuel evaporative gas to adsorb to activated carbon placed in the canister. Then, the fuel evaporative gas emission suppression system performs purge treatment, whereby the changeover valve and the purge valve are opened while the internal combustion engine is in operation so that the fuel evaporative gas adsorbed to the activated carbon in the canister is discharged to the intake passage of the internal combustion engine, thereby treating the fuel evaporative gas.

Further, there have been developed techniques for detecting a leakage of fuel evaporative gas from a fuel evaporative gas emission suppression system, and a failure of a valve in the same system.

For example, there is a technique which is configured to produce negative pressure in a purge passage and a fuel tank by controlling opening/closing of a changeover valve, a sealing valve and a purge valve when the internal combustion engine is in operation and by taking advantage of negative pressure generated in the intake passage of the internal combustion engine, and to detect an abnormality such as a leakage and a failure of a valve based on whether the negative pressure is retained or not retained.

However, in a vehicle such as a plug-in hybrid vehicle which is provided with an electric motor in addition to an internal combustion engine, and which travels mainly by the driving force of the electric motor, there is less chance that the internal combustion engine is operated, to improve fuel economy, and therefore there will be less chance that abnormality detection can be performed when performing abnormality detection of a fuel evaporative gas emission suppression system while the internal combustion engine is in operation.

Accordingly, as a fuel evaporative gas emission suppression system to be provided in a vehicle in which the internal combustion engine has less chance to be operated, there is an example which includes a negative pressure pump capable of reducing the pressure in passages of the fuel evaporative gas emission suppression system, and controls the operation of the negative pressure pump and the opening/closing of a changeover valve, a sealing valve and a purge valve while the internal combustion engine is stopped, thereby performing abnormality detection of the fuel evaporative gas emission suppression system based on changes of intake pressure of the negative pressure pump and pressure in the fuel tank (see Japanese Patent No. 4352945).

Further, there is developed a fuel evaporative gas emission suppression system in which an opening/closing valve (canister opening/closing valve) is provided between the communication path and the canister instead of the canister being directly mounted in the communication path in the fuel evaporative gas emission suppression system having a negative pressure pump as shown in the above described patent publication.

In this fuel evaporative gas emission suppression system, by closing the canister opening/closing valve, it is made possible to discharge fuel evaporative gas from the fuel tank into an intake passage of the internal combustion engine via a communication path without making it flow into the canister, thus making it possible to restrict fuel evaporative gas from adsorbing to the canister.

Then, in a fuel evaporative gas emission suppression system having a canister opening/closing valve as described above, it is demanded to detect abnormalities such as open sticking and closed sticking of the canister opening/closing valve.

Moreover, in the fuel evaporative gas emission suppression system according to the above described patent publication, purge flow monitoring is enabled which determines that purge treatment is possible based on a fact that pressure in the canister decreases by not less than a predetermined value when the purge valve is released when the internal combustion engine is in operation.

In such a fuel evaporative gas emission suppression system in which purge flow monitoring is possible and moreover a canister opening/closing valve is provided, it is demanded to perform not only purge flow monitoring, but also detection of abnormalities such as open sticking of the canister opening/closing valve.

SUMMARY OF THE INVENTION

Accordingly, it is an object of the present invention to provide a fuel evaporative gas emission suppression system which is capable of abnormality detecting of a canister opening/closing valve.

To achieve the above described object, a fuel evaporative gas emission suppression system relating to the present invention is configured to include: a communication path configured to communicate between an intake passage and a fuel tank of an internal combustion engine; a canister connected to the communication path and that adsorbs fuel evaporative gas in the communication path; a canister opening/closing valve configured to open and close communication between the communication path and the canister; a purge valve configured to open and close the communication path between the intake passage and the canister; a pressure generator configured to generate pressure in the canister via a communication hole that communicates between inside and outside of the canister; a pressure detector configured to detect internal pressure of the canister; and a control unit that, when the internal combustion engine is in a stopped state, turns the purge valve into an open state, actuates the pressure generator, and controls the canister opening/closing valve to be opened/closed, and performs abnormality detection control of the canister opening/closing valve based on a change of the internal pressure of the canister detected by the pressure detector.

According to this configuration, if the pressure generator operates with the canister opening/closing valve being in a closed state, the internal pressure of the canister readily changes. Moreover, when the purge valve is in an open state and, in addition, the canister opening/closing valve is in an open state, since the canister is in communication with the intake passage via the communication path, the internal pressure of the canister will hardly change even if the pressure generator is actuated when the internal combustion engine is stopped.

Therefore, by controlling the opening/closing of the canister opening/closing valve with the purge valve being in an open state and the pressure generator being actuated, it is possible to determine whether the canister opening/closing valve is actually in an open state or in a closed state from a change of the internal pressure of the canister. Then, when the open/close control of the canister opening/closing valve does not agree with an actual open/close state of the canister opening/closing valve determined from the change in the internal pressure of the canister, it is possible to detect an abnormality of the canister opening/closing valve.

Or else, a fuel evaporative gas emission suppression system relating to the present invention is configured to comprise: a communication path configured to communicate between an intake passage and a fuel tank of an internal combustion engine; a canister connected to the communication path and that adsorbs fuel evaporative gas in the communication path; a canister opening/closing valve configured to open and close communication between the canister and the communication path; a purge valve configured to open and close the communication path between the intake passage and the canister; a pressure generator configured to generate pressure in the canister via a communication hole that communicates between inside and outside of the canister; a pressure detector configured to detect internal pressure of the canister; and a control unit that turns the purge valve into a closed state, actuates the pressure generator, and controls the canister opening/closing valve to be opened/closed, and performs abnormality detection control of the canister opening/closing valve based on a change rate of the internal pressure of the canister detected by the pressure detector.

According to this configuration, when the pressure generator operates with the canister opening/closing valve being in a closed state, the internal pressure of the canister readily changes. On the other hand, when the canister opening/closing valve is in an open state, since the canister is opened to the communication path, the changing rate of the internal pressure of the canister when the pressure generator is actuated is suppressed.

Therefore, it is possible to determine whether the canister opening/closing valve is actually in an open state or in a closed state based on a change rate of the internal pressure of the canister caused by the operation of the pressure generator. Moreover, when the open/close control of the canister opening/closing valve does not agree with an actual open/close state of the canister opening/closing valve determined from the change rate of the internal pressure of the canister, it is possible to detect an abnormality of the canister opening/closing valve.

Or else, a fuel evaporative gas emission suppression system relating to the present invention is configured to comprise: a communication path configured to communicate between an intake passage and a fuel tank of an internal combustion engine; a canister connected to the communication path and that adsorbs fuel evaporative gas in the communication path; a canister opening/closing valve configured to open and close communication between the communication path and the canister; a purge valve configured to open and close the communication path between the intake passage and the canister; a pressure detector configured to detect internal pressure of the canister; a purge function determiner that opens the purge valve and the canister opening/closing valve while the internal combustion engine is operated, and determines if a purge function of the canister is normal based on a change in the internal pressure of the canister detected by the pressure detector; and a canister opening/closing valve abnormality detector configured to perform abnormality detection of the canister opening/closing valve based on the determination by the purge function.

According to this configuration, it is possible to accurately perform failure detection of the canister opening/closing valve based on a purge function determination, thereby allowing a failure detection of the canister opening/closing valve in a short period of time.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Hereafter, embodiments of the present invention will be described based on the drawings.

Figure 1:
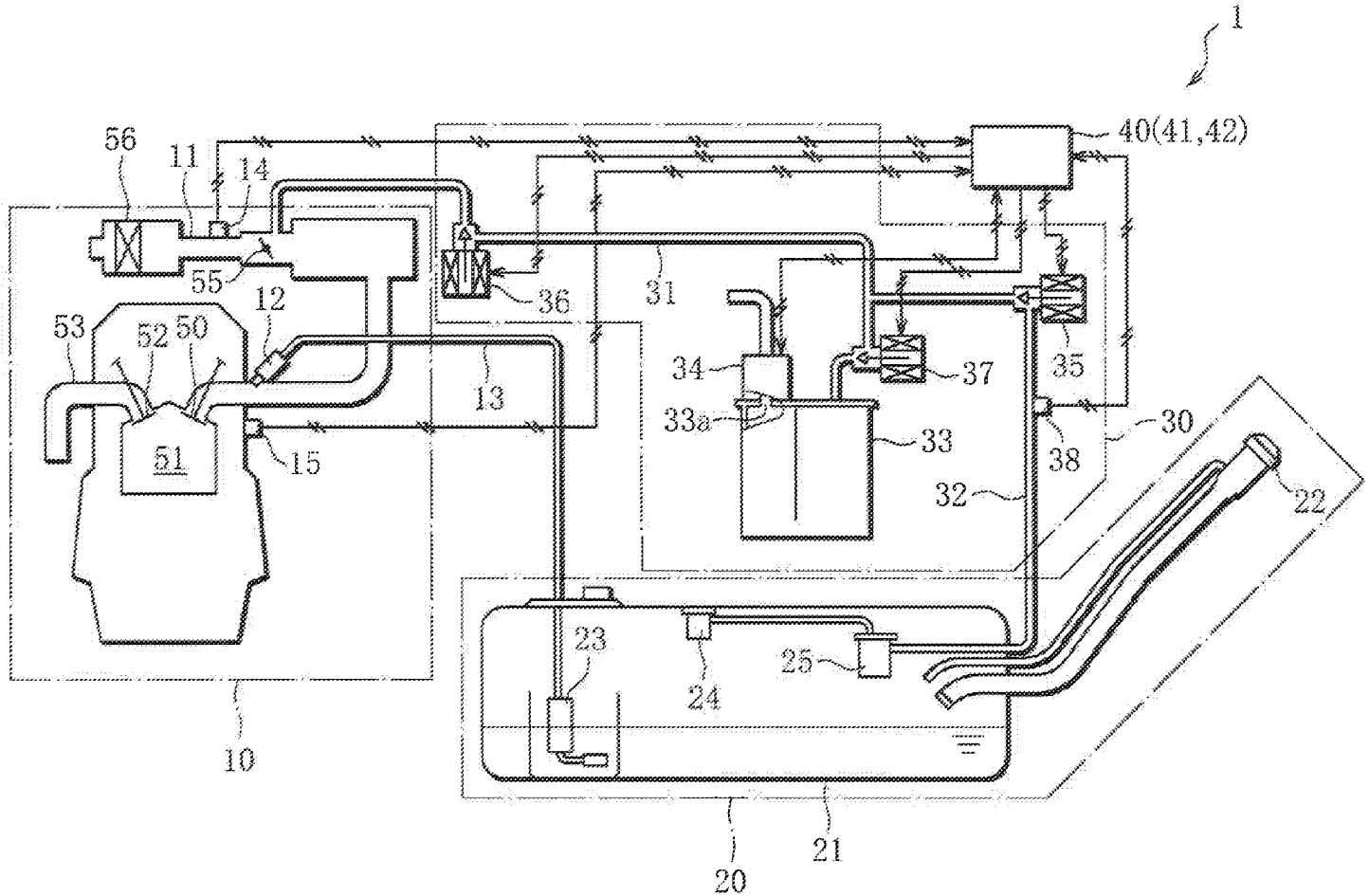
FIG. 1 is a schematic block diagram of a fuel evaporative gas emission suppression system relating to an embodiment of the present invention.
Figure 2:
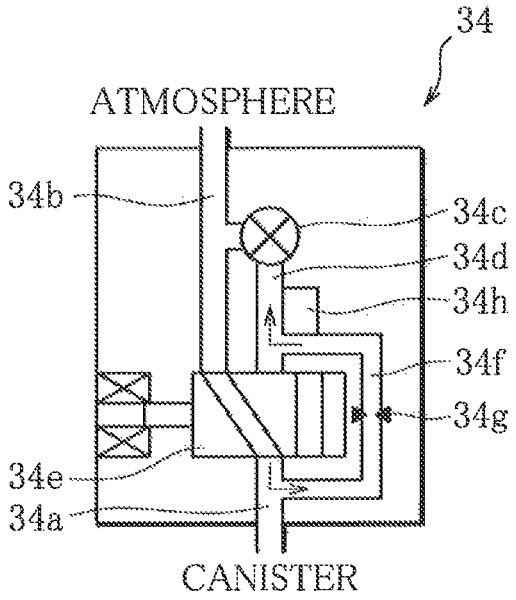
FIG. 2 is a diagram to show operation of internal components of a changeover valve of an evaporative leak check module when not in operation.
Figure 3:
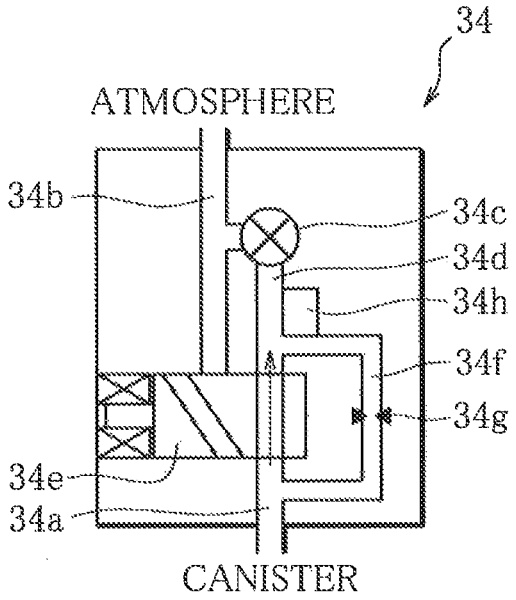
FIG. 3 is a diagram to show internal components of the changeover valve of the evaporative leak check module when in operation.

FIG. 1 is a schematic block diagram of a fuel evaporative gas emission suppression system 1 relating to an embodiment of the present invention. Moreover, FIG. 2 is a diagram to show operation of internal components of a changeover valve 34*e* of an evaporative leak check module 34 when not in operation, and FIG. 3 is a diagram to show operation of the internal components of the changeover valve 34*e* of the evaporative leak check module 34 when in operation. Each arrow in FIGS. 2 and 3 shows a flow direction of air when a negative pressure pump 34*c* in the evaporative leak check module 34 is actuated in a state as shown in respective figures. It is noted that the changeover valve 34*e* is in an open state when not in operation as shown in FIG. 2, and in a closed state when in operation as shown in FIG. 3. Hereafter, the configuration of the fuel evaporative gas emission suppression system 1 will be described.

The fuel evaporative gas emission suppression system 1 of the present embodiment includes a travelling motor not shown and an engine 10 (internal combustion engine), and is used for a hybrid vehicle or a plug-in hybrid vehicle, etc. which travels using either one or both of them.

As shown in FIG. 1, the fuel evaporative gas emission suppression system 1 is generally made up of an engine 10 mounted on the vehicle, a fuel storage portion 20 for storing fuel, a fuel evaporative gas treatment portion 30 for treating evaporative gas of fuel which is evaporated in the fuel storage portion 20, and an electronic control unit 40 (41, 42) which is a control apparatus for performing comprehensive control of the vehicle.

It is noted that the electronic control unit 40 of a first embodiment, and the electronic control unit 41 of a second embodiment correspond to the control unit of the present invention, and the electronic control unit 42 of a third embodiment corresponds to a purge function determiner and a canister opening/closing valve abnormality detector of the present invention.

The engine 10 is a gasoline engine of an intake passage injection type (Multi Point Injection: MPI). The engine 10 is provided with an intake passage 11 for taking air into a combustion chamber of the engine 10. Moreover, in the downstream of the intake passage 11, a fuel injection valve 12 for injecting fuel into an intake port of the engine 10 is provided. A fuel pipe 13 is connected to the fuel injection valve 12 so that fuel is supplied from a fuel tank 21 for storing fuel.

An intake air temperature sensor 14 for detecting the temperature of intake air is arranged in the intake passage 11 of the engine 10. Moreover, a water temperature sensor 15 for detecting the temperature of cooling water for cooling the engine 10 is arranged in the engine 10.

The fuel storage portion 20 is made up of a fuel tank 21, a fuel feed port 22 which is a fuel inlet to the fuel tank 21, a fuel pump 23 for supplying fuel from the fuel tank 21 to the fuel injection valve 12 via a fuel pipe 13, a fuel cut-off valve 24 for preventing fuel from flowing out of the fuel tank 21 to a fuel evaporative gas treatment portion 30, and a leveling valve 25 for controlling the liquid level in the fuel tank 21 during fueling. Moreover, fuel evaporative gas generated in the fuel tank 21 is discharged by the fuel cut-off valve 24 into the fuel evaporative gas treatment portion 30 via the leveling valve 25.

The fuel evaporative gas treatment portion 30 includes a purge pipe (communication path) 31, a vapor pipe (communication path) 32, a canister 33, an evaporative leak check module 34, a sealing valve 35 (tank opening/closing valve), a purge valve 36, a bypass valve 37 (canister opening/closing valve), and a pressure sensor 38.

The purge pipe 31 is provided so as to communicate the intake passage 11 and the canister 33 of the engine 10 with each other.

The vapor pipe 32 is provided so as to communicate the leveling valve 25 of the fuel tank 21 and the purge pipe 31 with each other. That is, the vapor pipe 32 is provided so as to communicate the fuel tank 21 and the purge pipe 31 with each other.

The canister 33 accommodates activated carbon thereinside. Moreover, the purge pipe 31 is connected to the canister 33 such that fuel evaporative gas generated in the fuel tank 21 or fuel evaporative gas adsorbed to the activated carbon can circulate. Further, the canister 33 is provided with an atmospheric hole (communication hole) 33*a* for taking in ambient air when releasing the fuel evaporative gas that has adsorbed to the activated carbon into the intake passage 11 of the engine 10.

As shown in FIGS. 2 and 3, the evaporative leak check module 34 is provided with a canister side passage 34*a* leading to the atmospheric hole 33*a* of the canister 33, and an atmosphere side passage 34*b* leading to the atmosphere. A pump passage 34*d* including a negative pressure pump (pressure generator) 34*c* is in communication with the atmosphere side passage 34*b*. Moreover, the evaporative leak check module 34 is provided with a changeover valve 34*e* and a bypass passage 34*f*. The changeover valve 34*e* includes an electromagnetic solenoid and is driven by the same electromagnetic solenoid. The changeover valve 34*e* causes the canister side passage 34*a* and the atmosphere side passage 34*b* to communicate with each other (corresponding to an open state of the changeover valve 34*e*) as shown in FIG. 2 when the electromagnetic solenoid is not energized (OFF). Moreover, the changeover valve 34*e* communicates the canister side passage 34*a* and the pump passage 34*d* with each other (corresponding to a closed state of the changeover valve 34*e*) as shown in FIG. 3 when the electromagnetic solenoid is supplied with a driving signal from the outside, and is thereby energized (ON). The bypass passage 34*f* is a passage that connects the canister side passage 34*a* and the pump passage 34*d* to each other all the time. Further, the bypass passage 34*f* is provided with a reference orifice 34*g* having a small diameter (for example, a diameter of 0.45 mm). Further, a pressure sensor 34*h* (pressure detector) for detecting the pressure in the pump passage 34*d* or in the bypass passage 34*f* downstream the reference orifice 34*g* is provided between the negative pressure pump 34*c* in the pump passage 34*d* and the reference orifice 34*g* of the bypass passage 34*f*.

The pressure sensor 34*h* is intended to detect a canister internal pressure which is the internal pressure of the canister 33.

The sealing valve 35 is mounted in the vapor pipe 32 between the fuel tank 21 and the purge pipe 31. The sealing valve 35 includes an electromagnetic solenoid and is driven by the same electromagnetic solenoid. The sealing valve 35 is a normally-closed type electromagnetic valve which turns into a closed state when the electromagnetic solenoid is not energized (OFF), and into an open state when the electromagnetic solenoid is supplied with a driving signal from the outside and becomes energized (ON). The sealing valve 35 blocks the vapor pipe 32 when the electromagnetic solenoid is not energized (OFF) and the sealing valve 35 is in a closed state, and releases the vapor pipe 32 when the electromagnetic solenoid is supplied with a driving signal from the outside to become energized (ON), and the sealing valve 35 is in an open state. That is, when in a closed state, the sealing valve 35 blocks the fuel tank 21 in a sealed state, thereby disabling the fuel evaporative gas generated in the fuel tank 21 from flowing out into the canister 33 or the intake passage 11 of the engine 10, and when in an open state, it enables the fuel evaporative gas to flow out into the canister 33 or the intake passage 11 of the engine 10.

The purge valve 36 is mounted in the purge pipe 31 between the intake passage 11 and a joint portion between the purge pipe 31 and the vapor pipe 32. The purge valve 36 includes an electromagnetic solenoid and is driven by the same electromagnetic solenoid. The purge valve 36 is a normally-closed type electromagnetic valve which turns into a closed state when the electromagnetic solenoid is not energized (OFF), and turns into an open state when the electromagnetic solenoid is supplied with a driving signal from the outside and becomes energized (ON). The purge valve 36 blocks the purge pipe 31 when the electromagnetic solenoid is not energized (OFF) and the purge valve 36 is in a closed state, and releases the purge pipe 31 when the electromagnetic solenoid is supplied with a driving signal from the outside and becomes energized (ON), turning the purge pipe 31 into an open state. That is, when in a closed state, the purge valve 36 disables the fuel evaporative gas to flow out from the canister 33 or the fuel tank 21 into the intake passage 11 of the engine 10, and when in an open state, it enables the fuel evaporative gas to flow out from the canister 33 or the fuel tank 21 into the intake passage 11 of the engine 10.

The bypass valve 37 is mounted in the purge pipe 31 between a joint portion between the purge pipe 31 and the vapor pipe 32, and the canister 33. The bypass valve 37 includes an electromagnetic solenoid and is driven by the same electromagnetic solenoid. The bypass valve 37 is a normally-open type electromagnetic valve which turns into an open state when the electromagnetic solenoid is not energized (OFF), and turns into a closed state when the electromagnetic solenoid is supplied with a driving signal from the outside and becomes energized (ON). Further, the bypass valve 37 releases the canister 33 to the purge pipe 31 when the electromagnetic solenoid is not energized (OFF) and the bypass valve 37 is in an open state, and blocks the canister 33 when the electromagnetic solenoid is supplied with a driving signal from the outside and becomes energized (ON), and the bypass valve 37 is in a closed state. Thus, when in a closed state, the bypass valve 37 seals the canister 33 and disables fuel evaporative gas to flow out to the canister 33 or fuel evaporative gas to flow out from the canister 33. Further, when in an open state, the bypass valve 37 allows fuel evaporative gas to flow into the canister 33, or fuel evaporative gas to flow out from the canister 33.

The pressure sensor 38 is arranged in the vapor pipe 32 between the fuel tank 21 and the sealing valve 35. Moreover, the pressure sensor 38 is intended to detect a tank internal pressure which is the internal pressure of the fuel tank 21. Furthermore, the pressure sensor 38 can detect the internal pressure only of the fuel tank 21, only when the sealing valve 35 is closed and the fuel tank 21 is sealed.

The electronic control unit 40 (41, 42) is a control apparatus for performing comprehensive control of a vehicle, and is configured to include an input/output device, a storage device (ROM, RAM, nonvolatile RAM, etc.), a central processing unit (CPU), and a timer, etc.

The above described intake air temperature sensor 14, the water temperature sensor 15, the pressure sensor 34*h*, and the pressure sensor 38 are connected to the input side of the electronic control unit 40 (41, 42), to which detection information of these sensors is inputted.

On the other hand, the above described fuel injection valve 12, the fuel pump 23, the negative pressure pump 34*c*, the changeover valve 34*e*, the sealing valve 35, the purge valve 36, and the bypass valve 37 are connected to the output side of the electronic control unit 40 (41, 42).

The electronic control unit 40 (41, 42), based on detection information from various types of sensors, controls the operation of the negative pressure pump 34*c*, and opening/closing of the changeover valve 34*e*, the sealing valve 35, the purge valve 36, and the bypass valve 37, thereby performing purge treatment control for discharging fuel evaporative gas which is generated in the fuel tank 21 and is adsorbed to the canister 33, and fuel evaporative gas generated in the fuel tank 21, into the intake passage 11 of the engine 10 during the operation of the engine 10.

(First Embodiment)

An electronic control unit 40 relating to a first embodiment of the present invention performs detection of leakage of a fuel storage portion 20 and a fuel evaporative gas treatment portion 30 when the operation of the engine 10 is stopped, and abnormality detection control for detecting the presence or absence of open sticking in which a bypass valve 37 sticks in an open state and closed sticking in which the bypass valve 37 sticks in a closed state (open sticking determination control and closed sticking determination control).

Hereafter, using FIGS. 4 to 8, abnormality detection control of the bypass valve 37 in the electronic control unit 40 relating to thus configured first embodiment will be described. The abnormality detection control of the bypass valve 37 is performed during key-off or soaking, that is, when the operation of the engine 10 is stopped.

Figure 4:
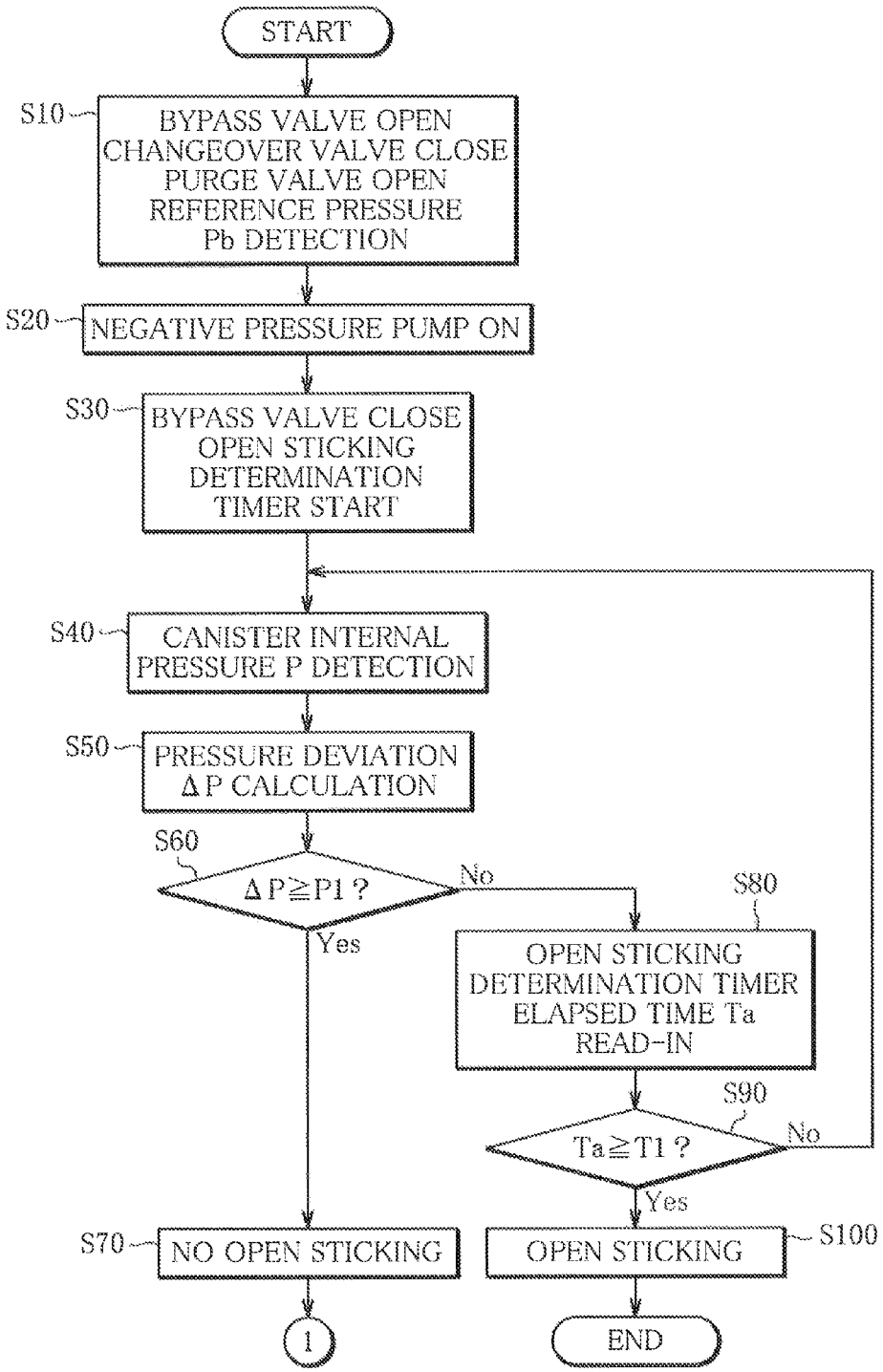
FIG. 4 is a part of a control flowchart of abnormality detection of a bypass valve, which is executed by an electronic control unit of a first embodiment of the present invention.
Figure 5:
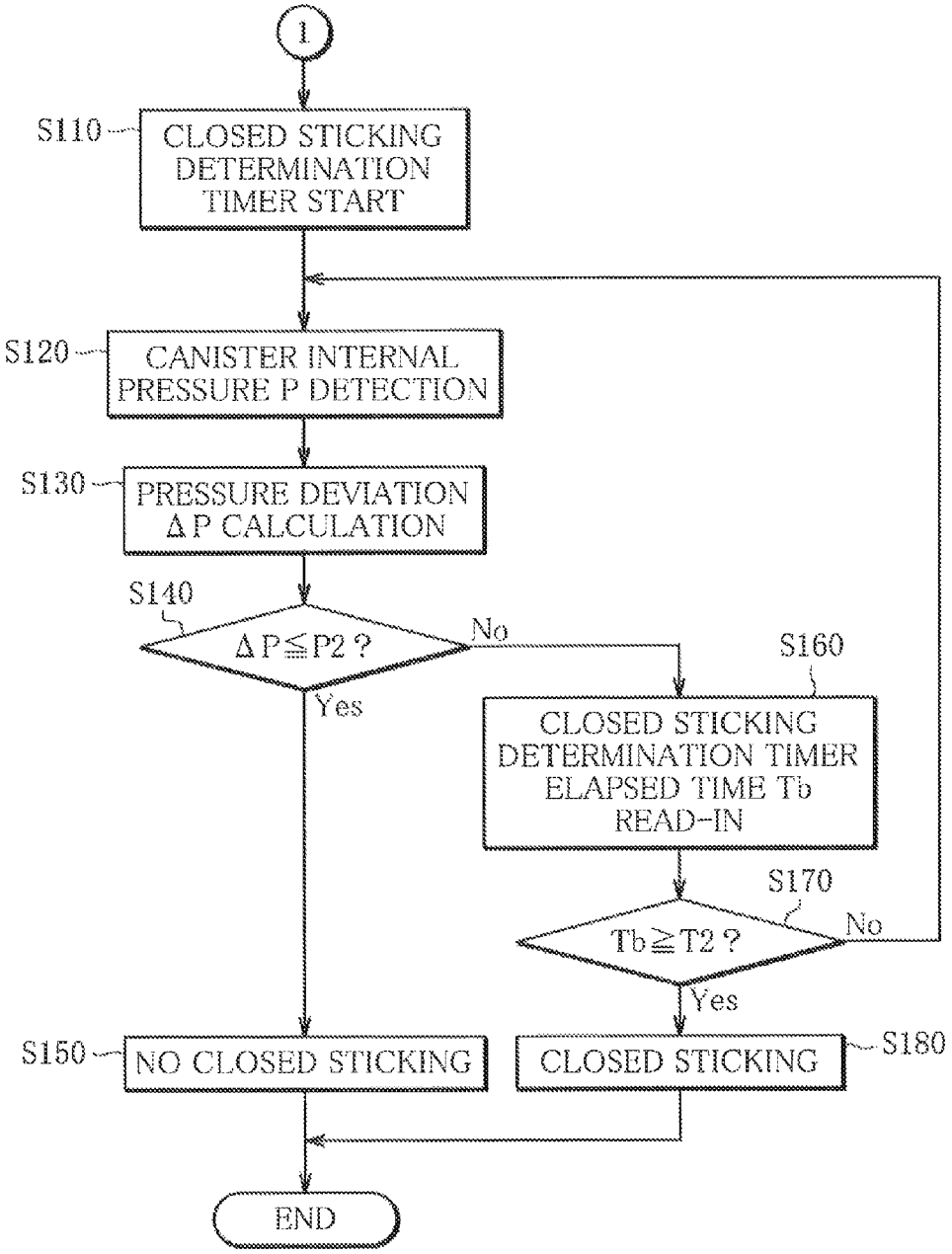
FIG. 5 is the rest of the control flowchart of abnormality detection of a bypass valve, which is executed by the electronic control unit of the first embodiment.

FIG. 4 is a part of a control flowchart of abnormality detection of the bypass valve 37 executed by the electronic control unit 40. FIG. 5 is the rest of the control flowchart of abnormality detection of a bypass valve 37 executed by the electronic control unit 40.

Figure 6:
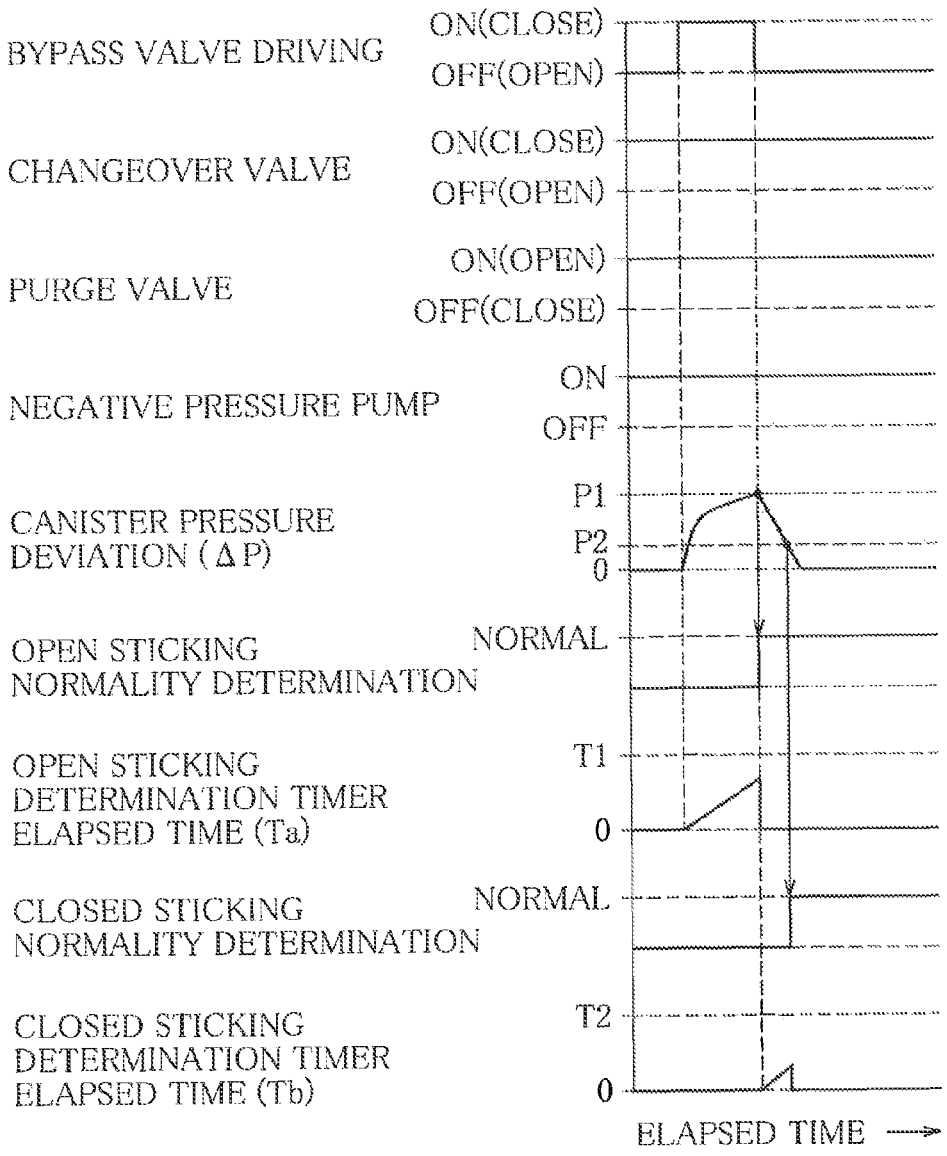
FIG. 6 is a time chart to show an example of transitions of a driving signal of a bypass valve, operations of each valve, a negative pressure pump, and each timer, and canister pressure deviation when determined that there is neither open sticking nor closed sticking in the electronic control unit of the first embodiment.
Figure 7:
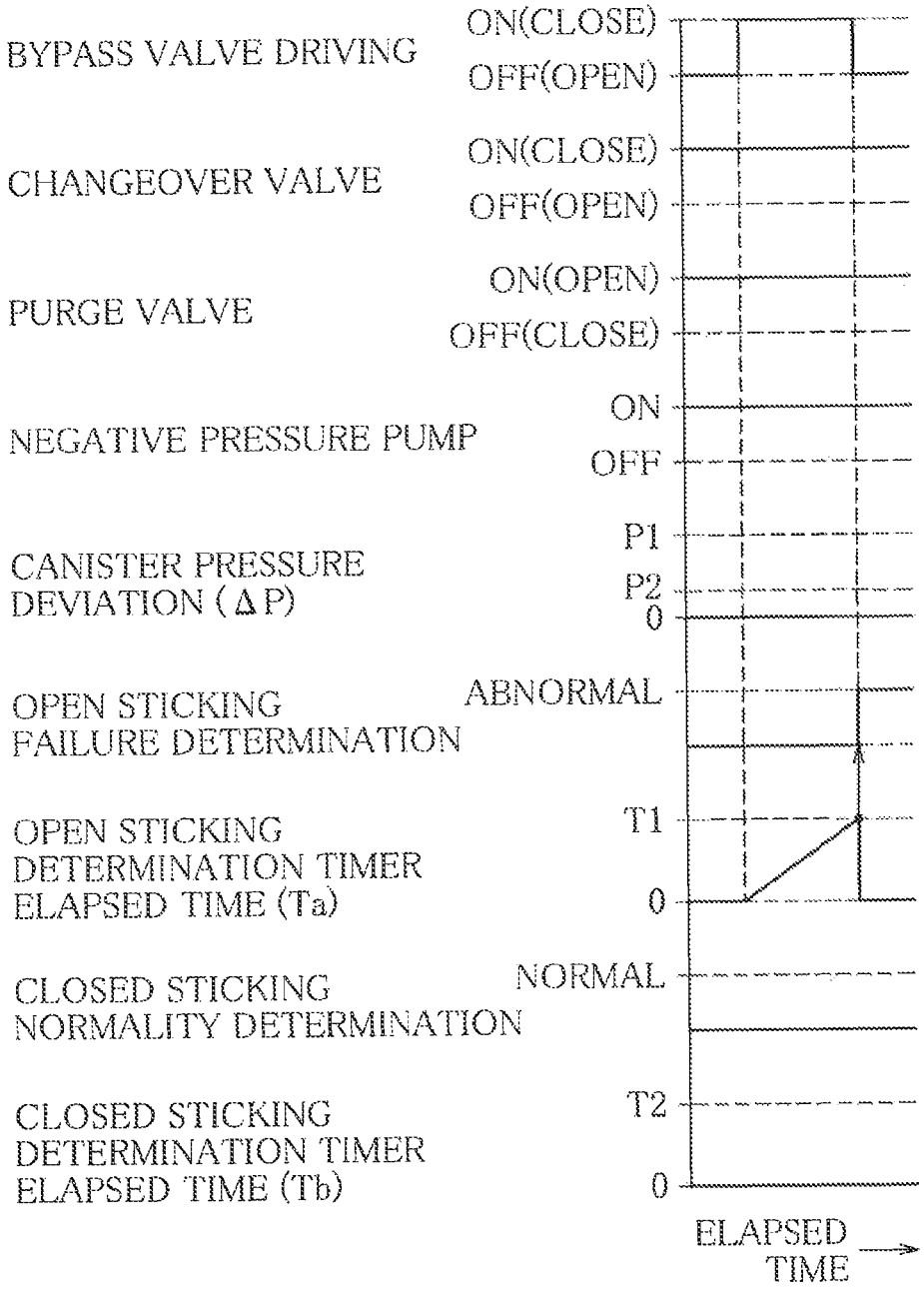
FIG. 7 is a time chart to show an example of transitions of a driving signal of a bypass valve, operations of each valve, a negative pressure pump, and each timer, and canister pressure deviation when determined that there is open sticking in the electronic control unit of the first embodiment.
Figure 8:
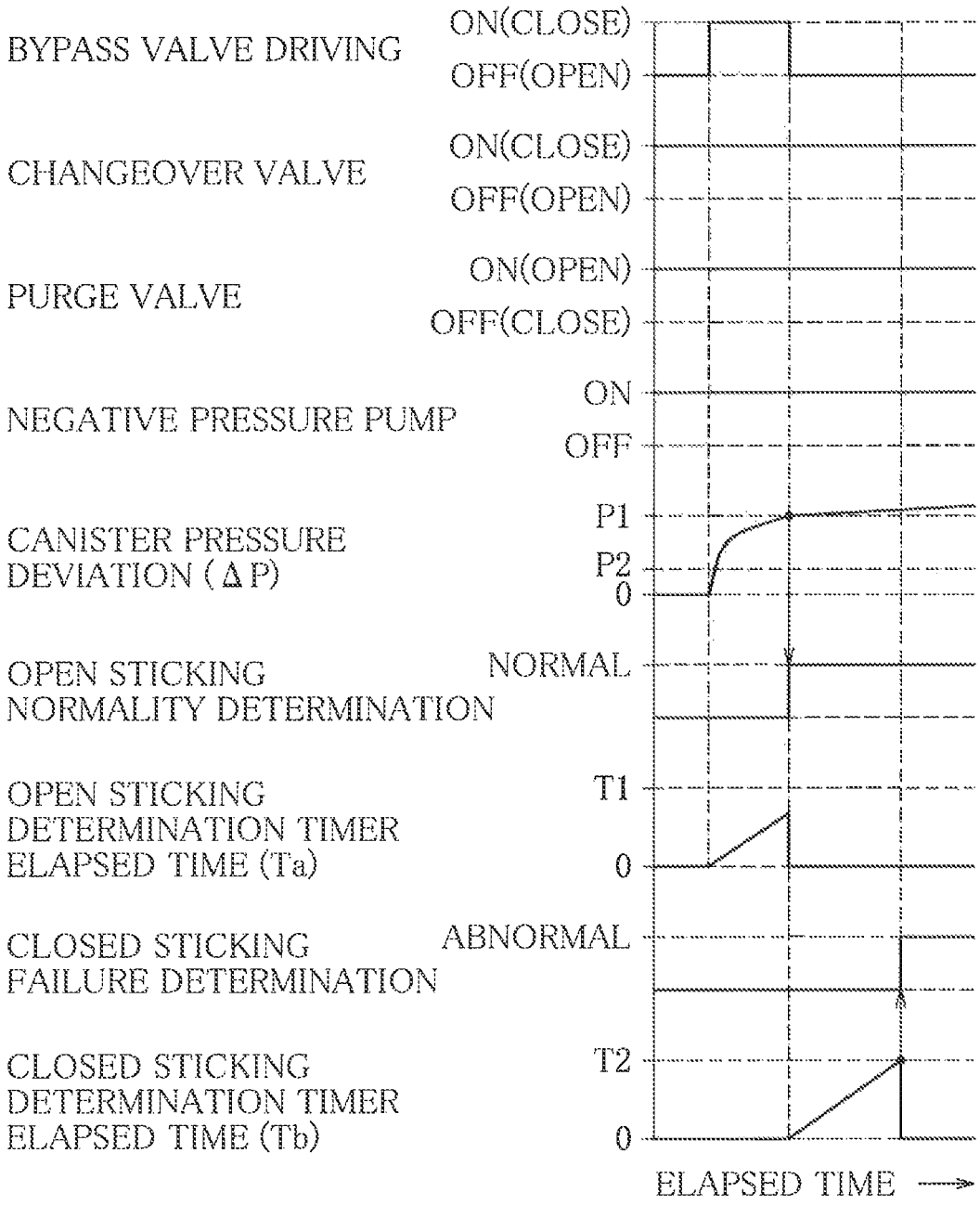
FIG. 8 is a time chart to show an example of transitions of a driving signal of a bypass valve, operations of each valve, a negative pressure pump, and each timer, and canister pressure deviation when it is determined that there is no open sticking, but there is closed sticking in the electronic control unit of the first embodiment.

Moreover, FIGS. 6 to 8 are time charts to show examples of transitions of the driving signal of the bypass valve 37 in the abnormality detection control of the bypass valve 37, operations of each valve (the changeover valve 34*e*, the purge valve 36), the negative pressure pump 34*c*, and each timer (bypass valve open sticking determination timer, bypass valve closed sticking determination timer), and pressure deviation of the canister. FIG. 6 shows an example in which it is determined that there is neither open sticking nor closed sticking of the bypass valve 37; FIG. 7 shows an example in which it is determined that there is open sticking; and FIG. 8 shows an example in which it is determined that there is no open sticking, but there is closed sticking.

In the abnormality detection control of the bypass valve 37, as shown in FIGS. 4 and 5, firstly in step S10, the changeover valve 34*e* is controlled to be closed, and the bypass valve 37 and the purge valve 36 are respectively controlled to be opened. Further, canister internal pressure is detected with the pressure sensor 34*h*, and the detected pressure is stored as a reference pressure Pb. Then, the process proceeds to step S20.

It is noted that when the engine 10 is stopped, the intake passage 11 is under the atmospheric pressure. This is because the downstream of the intake passage 11 is in communication with an exhaust pipe 53 via an intake valve 50, inside cylinder 51, and an exhaust valve 52, and thus the exhaust pipe 53 is opened to the atmosphere. Moreover, the upstream side of the intake passage 11 is also opened to the atmosphere side via a throttle valve 55 and an air cleaner 56. Since the pressure of the intake passage 11 is opened to the atmosphere side through gaps of these intake/exhaust valves 50, 51, gaps of the throttle valve 55, and the like while the engine 10 is stopped, the intake passage 11 is under the atmospheric pressure.

In step S20, the negative pressure pump 34*c* is started to operate. Then, the process proceeds to step S30.

In step S30, the bypass valve 37 is turned into a closed state, and an open sticking determination timer is started from 0. Then, the process proceeds to step S40.

In step S40, a canister internal pressure P is detected with the pressure sensor 34*h*. Then, the process proceeds to step S50.

In step S50, pressure deviation ΔP (=|P−Pb|) which is the difference between the canister internal pressure P detected in step S40 and the reference pressure Pb stored in step S10 is calculated. Then, the process proceeds to step S60.

In step S60, it is determined whether or not the pressure deviation ΔP calculated in step S50 is not less than a first predetermined pressure P1. The first predetermined pressure P1 may be set to a lower limit value of the pressure deviation ΔP which is reached when the negative pressure pump 34*c* is actuated for a first predetermined time period T1 with the bypass valve 37 being kept in a closed state, and which is confirmed in advance. It is noted that the first predetermined time period T1 may be appropriately set to a value whereby the pressure deviation ΔP will become sufficiently large by the operation of the negative pressure pump 34*c*. If the pressure deviation ΔP is not less than the first predetermined pressure P1, the process proceeds to step S70. If the pressure deviation ΔP is less than the first predetermined pressure P1, the process proceeds to step S80.

In step S70, it is determined that there is no open sticking in the bypass valve 37. Then, the process proceeds to step S110 of FIG. 5.

In step S80, an elapsed time Ta since the open sticking determination timer is started in step S30 is read in. Then, the process proceeds to step S90.

In step S90, it is determined whether or not the elapsed time Ta read in in step S80 is not less than the first predetermined time period T1. If the elapsed time Ta is not less than the first predetermined time period T1, the process proceeds to step S100. If the elapsed time Ta is less than the first predetermined time period T1, the process returns to step S40.

In step S100, it is determined that there is open sticking in the bypass valve 37. Then, the present routine is ended.

In step S110, the closed sticking determination timer is started from 0. Then, the process proceeds to step S120.

In step S120, the canister internal pressure P is detected with the pressure sensor 34*h*. Then, the process proceeds to step S130.

In step S130, the pressure deviation ΔP (=|P−Pb|) which is the difference between the canister internal pressure P detected in step S120 and the reference pressure Pb stored in step S10 is calculated. Then, the process proceeds to step S140.

In step S140, it is determined whether or not the pressure deviation ΔP calculated in step S130 is not more than a second predetermined pressure P2. The second predetermined pressure P2 may be set to an upper limit value of the pressure deviation ΔP, which is reached when a second predetermined time period T2 is elapsed from a state in which the pressure deviation is the first predetermined pressure P1 and which is confirmed in advance, and the bypass valve 37 turns into an open state, thereby releasing the pressure in the canister 33 to the intake passage 11 and reducing the pressure deviation ΔP. Here, the second predetermined time period T2 may be appropriately set to such a value as that the canister internal pressure is increased from a negative pressure state as a result of the opening of the bypass valve 37 so that the pressure deviation ΔP becomes around 0. If the pressure deviation ΔP is not more than the second predetermined pressure P2, the process proceeds to step S150. If the pressure deviation ΔP is more than the second predetermined pressure P2, the process proceeds to step S160.

In step S150, it is determined that there is no closed sticking in the bypass valve 37. Then, the present routine is ended.

In step S160, an elapsed time Tb since the closed sticking determination timer is started in step S110 is read in. Then, the process proceeds to step S170.

In step S90, it is determined whether or not the elapsed time Tb read in in step S160 is not less than the second predetermined time period T2. If the elapsed time Tb is not less than the second predetermined time T2, the process proceeds to step S180. If the elapsed time period Tb is less than the second predetermined time period T2, the process returns to step S120.

In step S180, it is determined that there is closed sticking in the bypass valve 37. Then, the present routine is ended.

It is noted that the above control according to steps S10 to S100 corresponds to the open sticking determination control of the present invention, and the control according to steps S110 to S180 corresponds to the closed sticking determination control.

As a result of performing the control as described above, in the fuel evaporative gas control system 1 relating to the present invention, for example as shown in FIG. 6, if the bypass valve 37 is normal, closing the bypass valve 37 and also closing the changeover valve 34*e* when the engine 10 is stopped and therefore negative pressure is not generated in the intake passage 11 will cause the canister 33 to be turned into a blocked state, so that actuating the negative pressure pump 34*c* causes the canister internal pressure P to be reduced from the atmospheric pressure, thereby causing the pressure deviation ΔP to increase. Then, if the pressure deviation ΔP reaches the first predetermined pressure P1 within the first predetermined time period T1, it can be determined that the bypass valve 37 is actually closed and is not in an open sticking state.

As shown in FIG. 7, when the bypass valve 37 is in an open sticking state, the canister internal pressure will hardly change even if the negative pressure pump 34*c* is actuated, and the pressure deviation ΔP will not increase. Therefore, it is possible to determine that the bypass valve 37 is in an open sticking state based on the fact that the pressure deviation ΔP does not increase to the first predetermined pressure P1 within the first predetermined time period T1 in spite of that closing control of the bypass valve 37 is performed.

When it is determined that the bypass valve 37 is not in an open sticking state, then, the bypass valve 37 is actuated to open from a state in which the pressure deviation ΔP has reached the first predetermined pressure P1. Opening the bypass valve 37 will cause the negative pressure in the canister 33 to be released to the intake passage 11, thereby reducing the pressure deviation ΔP since the engine 10 is stopped and the purge valve 36 is in an open state. Moreover, as shown in FIG. 6, if the pressure deviation ΔP decreases to the second predetermined pressure P2 before the second predetermined time period T2 has elapsed, it can be determined that the bypass valve 37 is not in a closed sticking state. As shown in FIG. 8, if the pressure deviation ΔP does not decrease to the second predetermined pressure P2 even when the second predetermined time period T2 has elapsed, it can be determined that the bypass valve 37 is in a closed sticking state.

In this way, by using the negative pressure pump 34*c* while keeping the purge valve 36 to be opened when the engine is stopped, it is possible to determine open sticking and closed sticking of the bypass valve 37 based on the change of pressure in the canister due to the opening/closing control of the bypass valve 37.

Moreover, in the above described embodiment, when the open sticking determination control is performed and it is determined that there is no open sticking, closed sticking determination control is performed successively from a state in which the pressure deviation ΔP has increased to the first predetermined pressure P1. This makes it possible to determine both open sticking and closed sticking successively in a short period of time.

Furthermore, since the determination of open sticking and closed sticking of the bypass valve 37 is performed based on the detection result of only the pressure sensor 34*h*, it is possible to reduce the possibility that determination is disabled due to failure of the pressure sensor, rather than when determination of open sticking and closed sticking of the bypass valve 37 is performed based on detection results of a plurality of pressure sensors.

(Second Embodiment)

Next, using FIGS. 9 to 14, abnormality detection control (open sticking determination control and closed sticking determination control) of a bypass valve 37 in an electronic control unit 41 relating to a second embodiment of the present invention will be described.

It is noted that the abnormality detection control of the bypass valve 37 relating to the second embodiment of the present invention is operable both when the engine 10 is in operation and being stopped.

Figure 9:
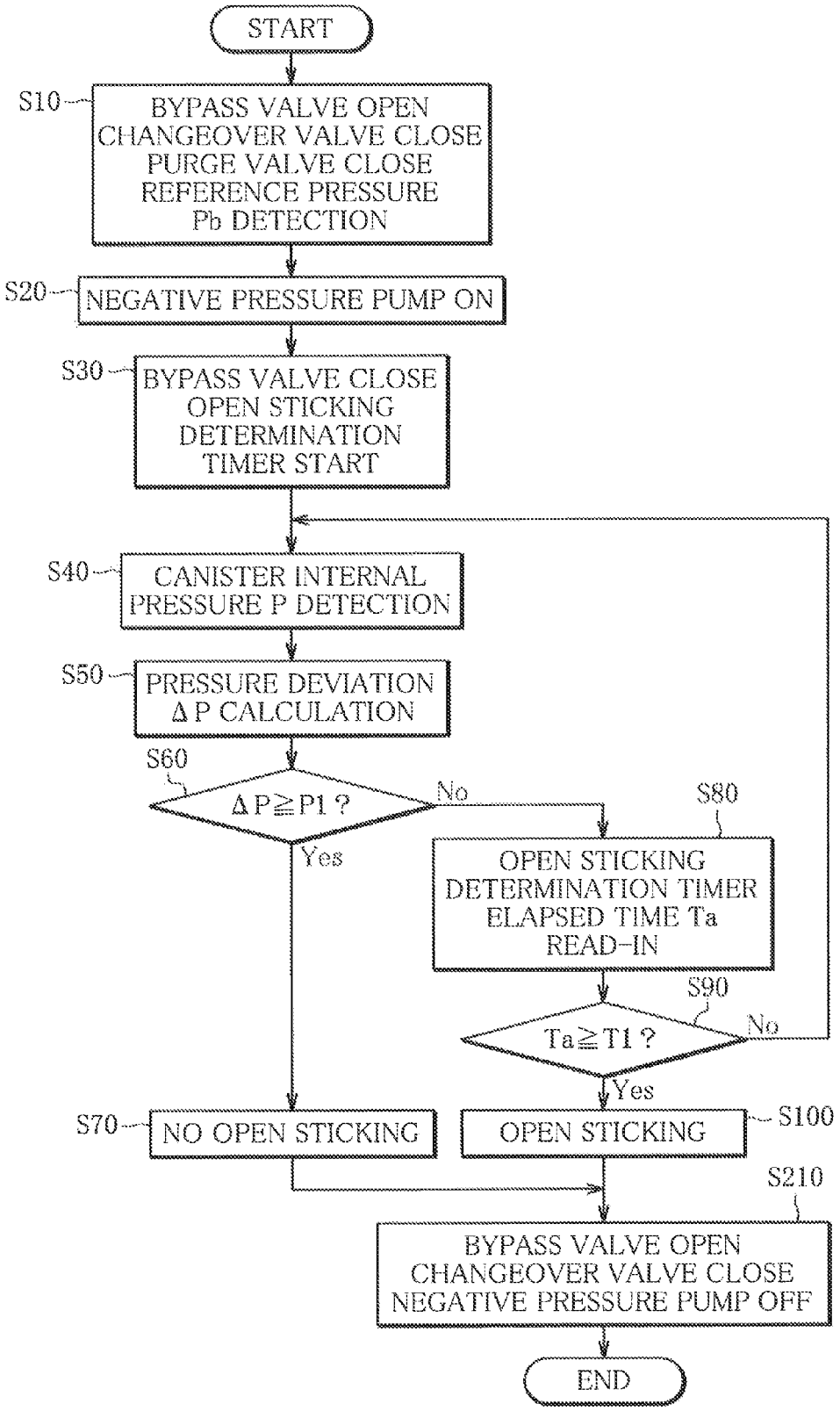
FIG. 9 is a control flowchart of open sticking determination control of a bypass valve, executed by an electronic control unit of a second embodiment of the present invention.
Figure 10:
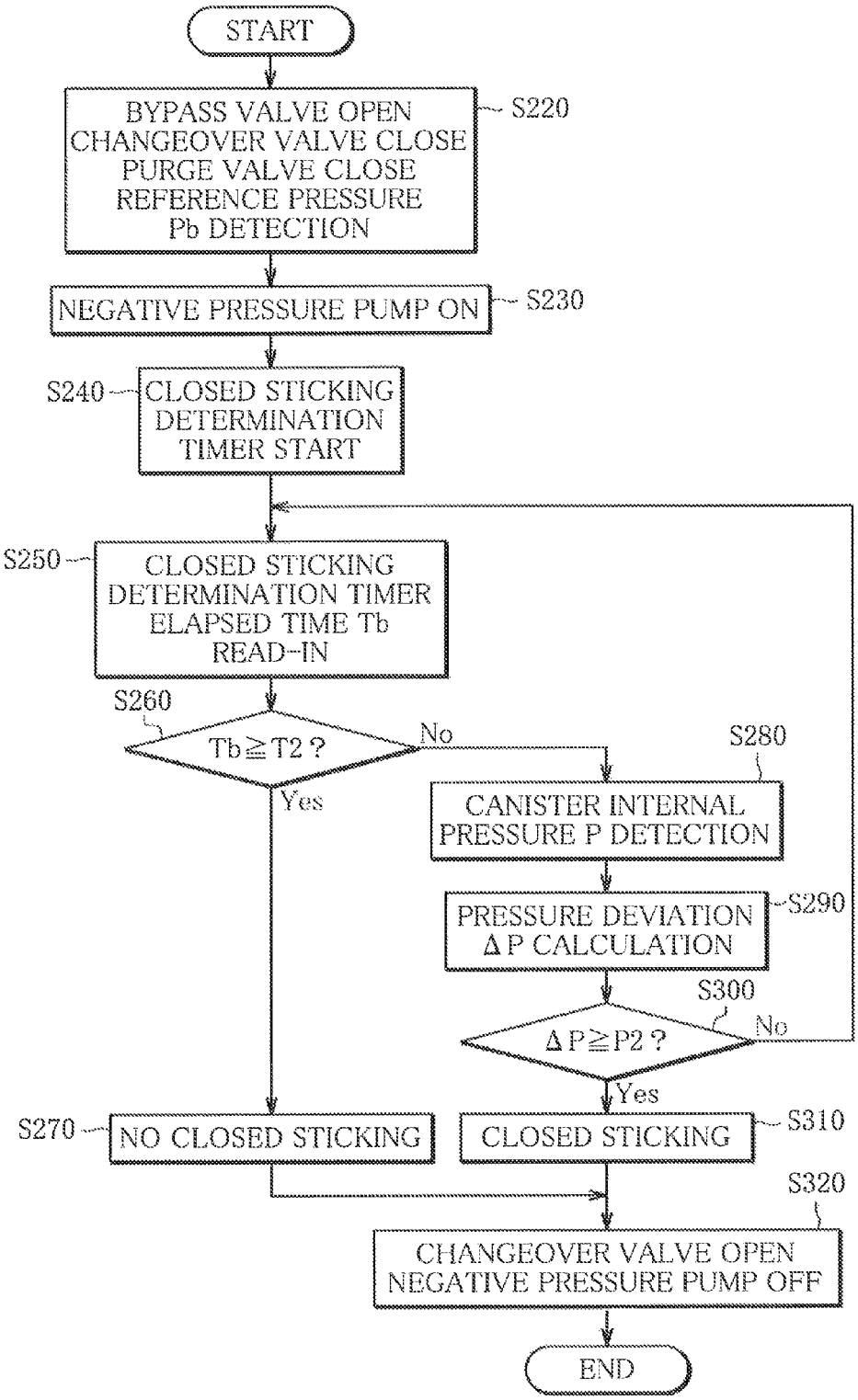
FIG. 10 is a control flowchart of closed sticking determination control of a bypass valve, executed by an electronic control unit of a second embodiment.

FIG. 9 is a control flowchart of open sticking determination control of the bypass valve 37 executed by the electronic control unit 41 of the second embodiment of the present invention. FIG. 10 is a control flowchart of closed sticking determination of the bypass valve 37 executed by the electronic control unit 41 of the second embodiment.

Figure 11:
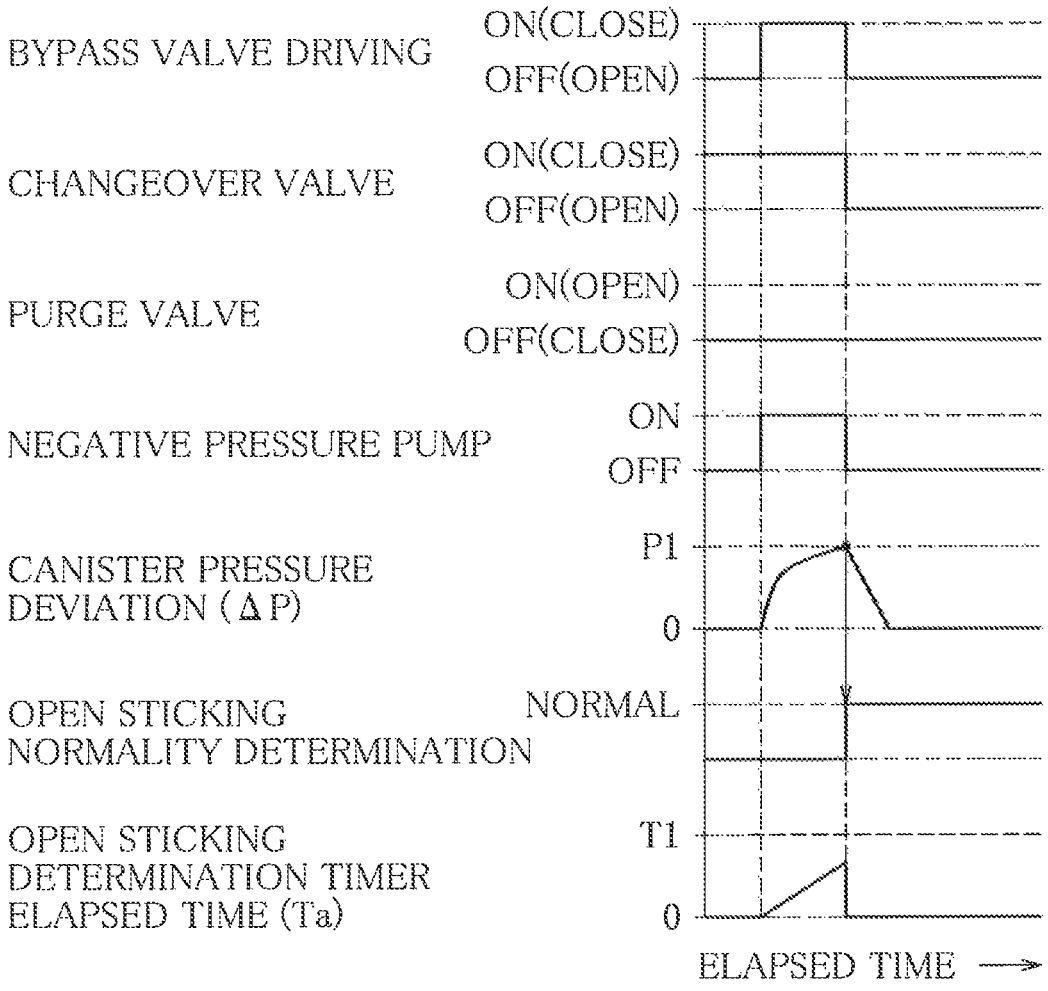
FIG. 11 is a time chart to show an example of transitions of a driving signal of a bypass valve, operations of each valve, a negative pressure pump, and each timer, and canister pressure deviation when it is determined that there is no open sticking in the electronic control unit of the second embodiment.
Figure 12:
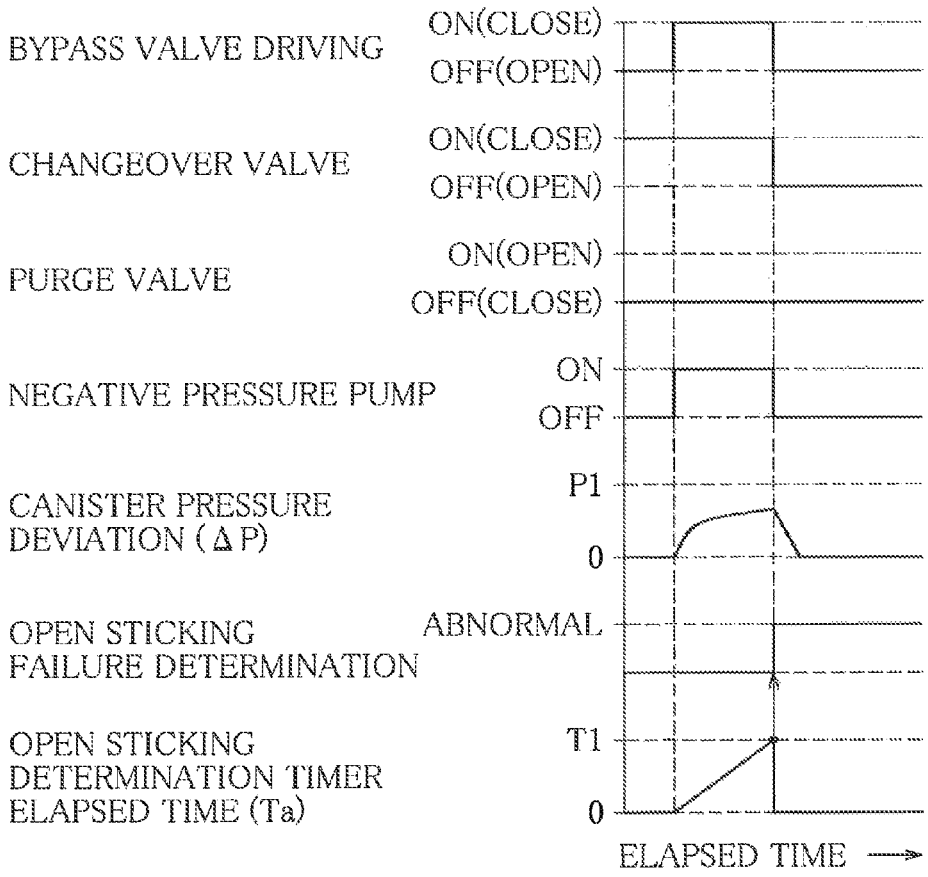
FIG. 12 is a time chart to show an example of transitions of a driving signal of a bypass valve, operations of each valve, a negative pressure pump, and each timer, and canister pressure deviation when determined that there is open sticking in the electronic control unit of the second embodiment.
Figure 13:
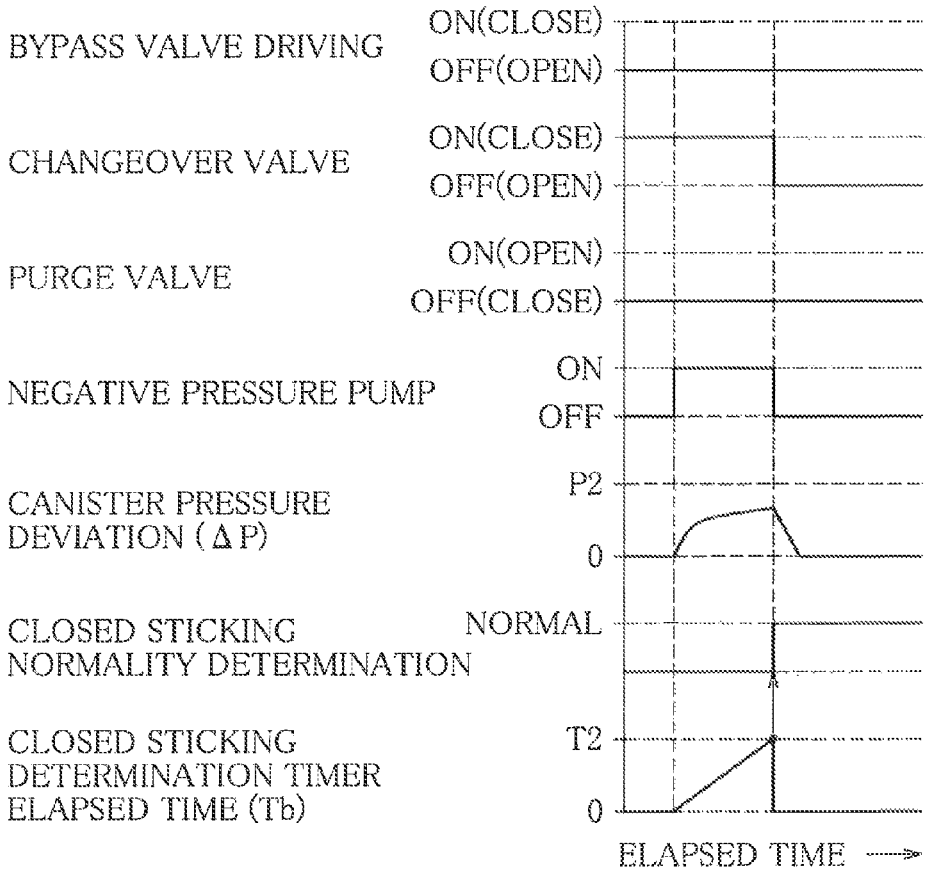
FIG. 13 is a time chart to show an example of transitions of a driving signal of a bypass valve, operations of each valve, a negative pressure pump, and each timer, and canister pressure deviation when determined that there is no closed sticking in the electronic control unit of the second embodiment.
Figure 14:
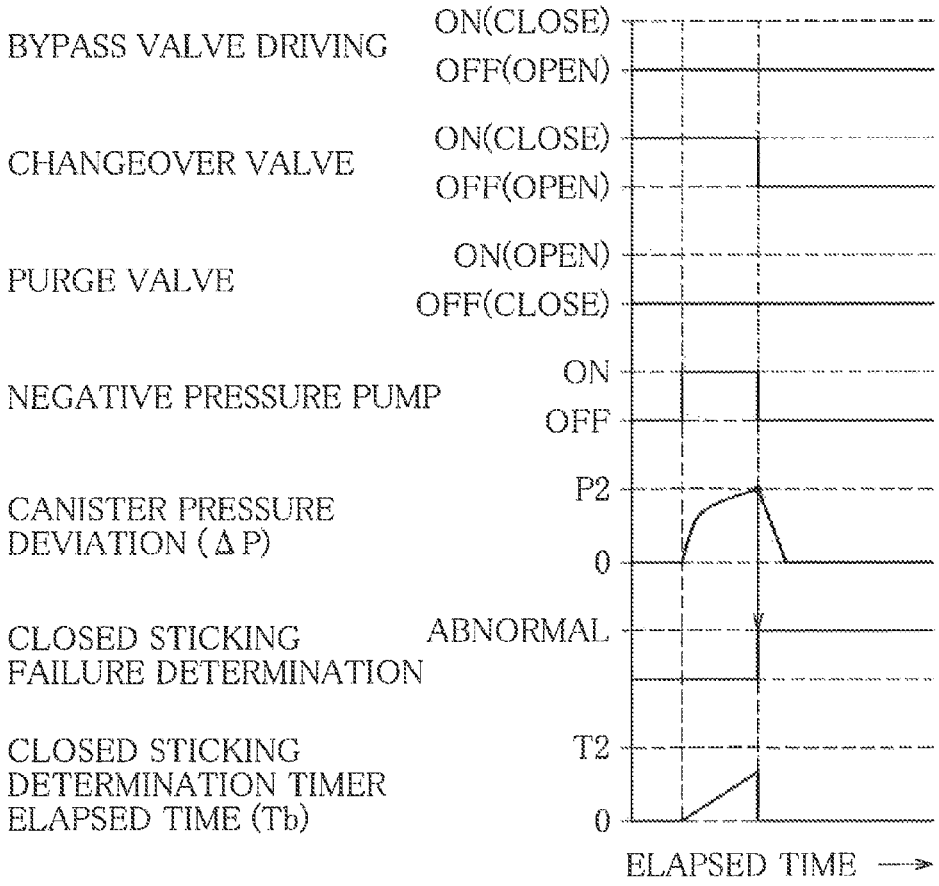
FIG. 14 is a time chart to show an example of transitions of a driving signal of a bypass valve, operations of each valve, a negative pressure pump, and each timer, and canister pressure deviation when determined that there is closed sticking in the electronic control unit of the second embodiment.

Moreover, FIGS. 11 to 14 are time charts to show transitions of a driving signal of the bypass valve 37, operations of each valve (changeover valve 34*e*, purge valve 36), the negative pressure pump 34*c*, each timer (a bypass valve open sticking determination timer, a bypass valve closed sticking determination timer), and pressure deviation of the canister 33 in each sticking determination control of the bypass valve 37 in the electronic control unit of the second embodiment. FIG. 11 shows an example in which it is determined that there is no open sticking in the bypass valve 37; FIG. 12 an example in which it is determined that there is open sticking; FIG. 13 an example in which it is determined that there is no closed sticking; and FIG. 14 an example in which it is determined that there is closed sticking.

In the open sticking determination control of the bypass valve 37, as shown in FIG. 9, the control contents of steps S10 to S100 are the same as those of the abnormality detection control of the above described first embodiment shown in FIG. 4.

After it is determined that there is no open sticking in the bypass valve 37 in step S70, the process proceeds to step S210.

Moreover, after it is determined that there is open sticking in the bypass valve 37 in step S100, the process proceeds to step S210.

In step S210, the bypass valve 37 and the changeover valve 34*e* are opened, and the negative pressure pump 34*c* is stopped (OFF). Then, the present routine is ended.

In the closed sticking determination control of the bypass valve 37, firstly in step S220, the bypass valve 37 is controlled to be opened, and the changeover valve 34*e* and the purge valve 36 are turned into a closed state respectively as shown in FIG. 10. Further, the canister internal pressure is detected with a pressure sensor 34*h*, and the detected pressure is stored as a reference pressure Pb. Then, the process proceeds to step S230.

In step S230, the negative pressure pump 34*c* is started to operate (ON). Then, the process proceeds to step S240.

In step S240, a closed sticking determination timer is started from 0. Then, the process proceeds to step S250.

In step S250, an elapsed time Tb since the closed sticking determination timer is started in step S240 is read in. Then, the process proceeds to step S260.

In step S260, it is determined whether or not the elapsed time Tb read in in step S250 is not less than a second predetermined time period T2. If the elapsed time Tb is not less than a second predetermined time period T2 to be described below, the process proceeds to step S270. If the elapsed time Tb is less than the second predetermined time period T2, the process proceeds to step S280. It is noted that the second predetermined time period T2 may be set to a pressure deviation ΔP which is reached when the negative pressure pump 34*c* is actuated with the changeover valve 34*e* being in a closed state when the bypass valve 37 is in a closed state.

In step S270, it is determined that there is no closed sticking in the bypass valve 37. Then, the process proceeds to step S320.

In step S280, a canister internal pressure P is detected with the pressure sensor 34*h*. Then, the process proceeds to step S290.

In step S290, a pressure deviation ΔP (=|P−Pb|) which is the difference between the canister internal pressure P detected in step S280 and the reference pressure Pb stored in step S220 is calculated. Then, the process proceeds to step S300.

In step S300, it is determined whether or not the pressure deviation ΔP calculated in step S290 is not less than a second predetermined pressure P2. The second predetermined pressure P2 may be set to an upper limit value of the pressure deviation ΔP which is reached when the negative pressure pump 34*c* is actuated for a second predetermined time period T2 which is appropriately set with the bypass valve 37 being kept in an open state, and which is confirmed in advance. If the pressure deviation ΔP is not less than the second predetermined pressure P2, the process proceeds to step S310. If the pressure deviation ΔP is less than the second predetermined pressure P2, the process returns to step S250.

In step S310, it is determined that there is closed sticking in the bypass valve 37. Then, the process proceeds to step S320.

In step S320, the changeover valve 34*e* is turned into an open state and the negative pressure pump 34*c* is stopped (OFF). Then, the present routine is ended.

As a result of the above described control, in the fuel evaporative gas emission suppression system 1 relating to the second embodiment of the present invention, for example as shown in FIG. 11, if the bypass valve 37 is normal, closing the bypass valve 37 and closing the changeover valve 34*e* will cause the canister 33 to be blocked so that actuating the negative pressure pump 34*c* causes the canister internal pressure P to decrease, and causes the pressure deviation ΔP to increase. Then, if the pressure deviation ΔP reaches the first predetermined pressure P1 within the first predetermined time period T1, it can be determined that the bypass valve 37 is actually in a closed state and is not in an open sticking state.

When the pressure deviation ΔP does not reach the first predetermined pressure P1 even when the first predetermined time period T1 has elapsed as shown in FIG. 12, it can be determined that the bypass valve 37 is actually in an open state in spite of that it is controlled to be closed, and thus the bypass valve 37 is in an open sticking state.

In this way, the actual open/close sate of the bypass valve 37 can be determined from a rate of reduction of the canister internal pressure P caused by the actuation of the negative pressure pump 34*c*. This is because if the bypass valve 37 is actually in an open state, the canister 33 and a purge pipe 31 are in communication with each other so that the volume of the space in communication with the negative pressure pump 34*c* becomes larger than that in the canister 33 alone, and therefore the rate of reduction of the pressure when the negative pressure pump 34*c* is actuated decreases. On the other hand, if the bypass valve 37 is actually in a closed state, the volume of the space in communication with the negative pressure pump 34*c* is only inside the canister 33, the rate of reduction of pressure when the negative pressure pump 34*c* is actuated increases. Therefore, if it is determined that the bypass valve 37 is in an open state from the rate of reduction of canister internal pressure P in spite of that the bypass valve 37 is controlled to be closed, it can be determined that the bypass valve 37 is in an open sticking state.

Moreover, if the changeover valve 34*e* is turned into a closed state, and the bypass valve 37 is turned into an open state, since the canister 33 and the purge pipe 31 are in communication with each other as described above, the canister internal pressure is not likely to be reduced even if the negative pressure pump 34*c* is actuated. Therefore, as shown in FIG. 13, if the pressure deviation ΔP does not reach the second predetermined pressure P2 within a second predetermined time period T2, it can be determined that the bypass valve 37 is actually in an open state, and is not in a closed sticking state. As shown in FIG. 9, if the pressure deviation ΔP reaches the second predetermined pressure P2 before the second predetermined time period T2 has elapsed, it can be determined that the bypass valve 37 is actually in a closed state in spite of that the bypass valve 37 is controlled to be opened, and the bypass valve 37 is in a closed sticking state.

In this way, by controlling the bypass valve 37 to be opened/closed with the changeover valve 34*e* being closed, it is possible to determine open sticking and closed sticking of the bypass valve 37 based on the change rate of the pressure in the canister when the negative pressure pump 34*c* is actuated. At this moment, since the purge valve 36 is in a closed state in each case, determination can be made regardless of the operational condition of the engine 10.

Furthermore, since the determination of open sticking and closed sticking of the bypass valve 37 is performed based on the detection result of the pressure sensor 34*h* alone, it is possible to reduce the possibility that the determination is disabled due to failure of the pressure sensor, rather than when determination of open sticking and closed sticking of the bypass valve 37 is performed based on detection results by a plurality of pressure sensors.

(Third Embodiment)

Next, using FIGS. 15 to 18, abnormality detection control (open sticking determination control) of a bypass valve 37 in an electronic control unit 42 relating to a third embodiment of the present invention will be described. It is noted that the electronic control unit 42 relating to the third embodiment performs purge flow monitoring for determining whether or not purge treatment control is actually carried out when the engine is in operation, and is capable of detecting open sticking in which the bypass valve 37 in in an open sticking state.

Figure 15:
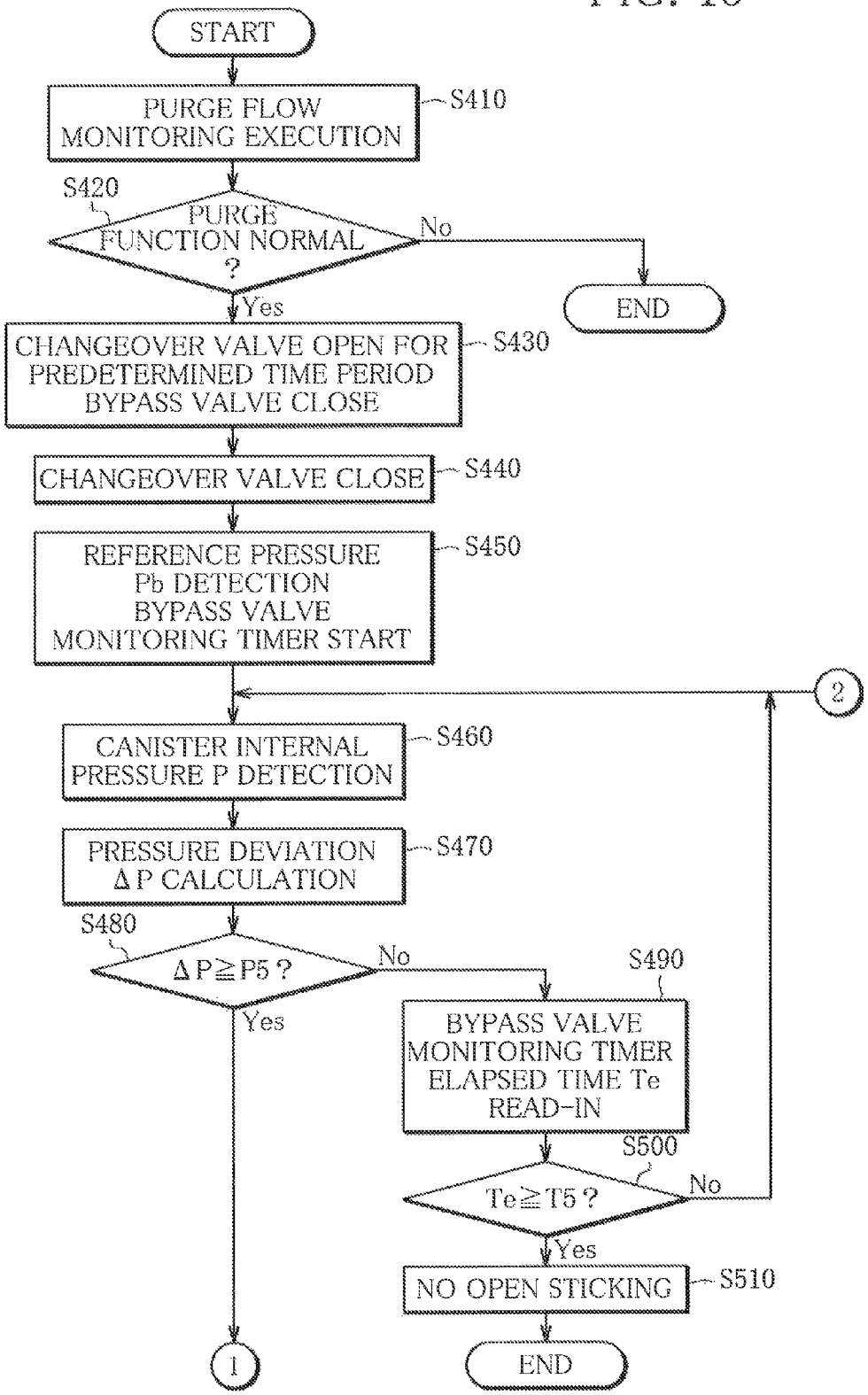
FIG. 15 is a part of a control flowchart of sticking determination control of a bypass valve, which is executed by an electronic control unit of a third embodiment of the present invention.
Figure 16:
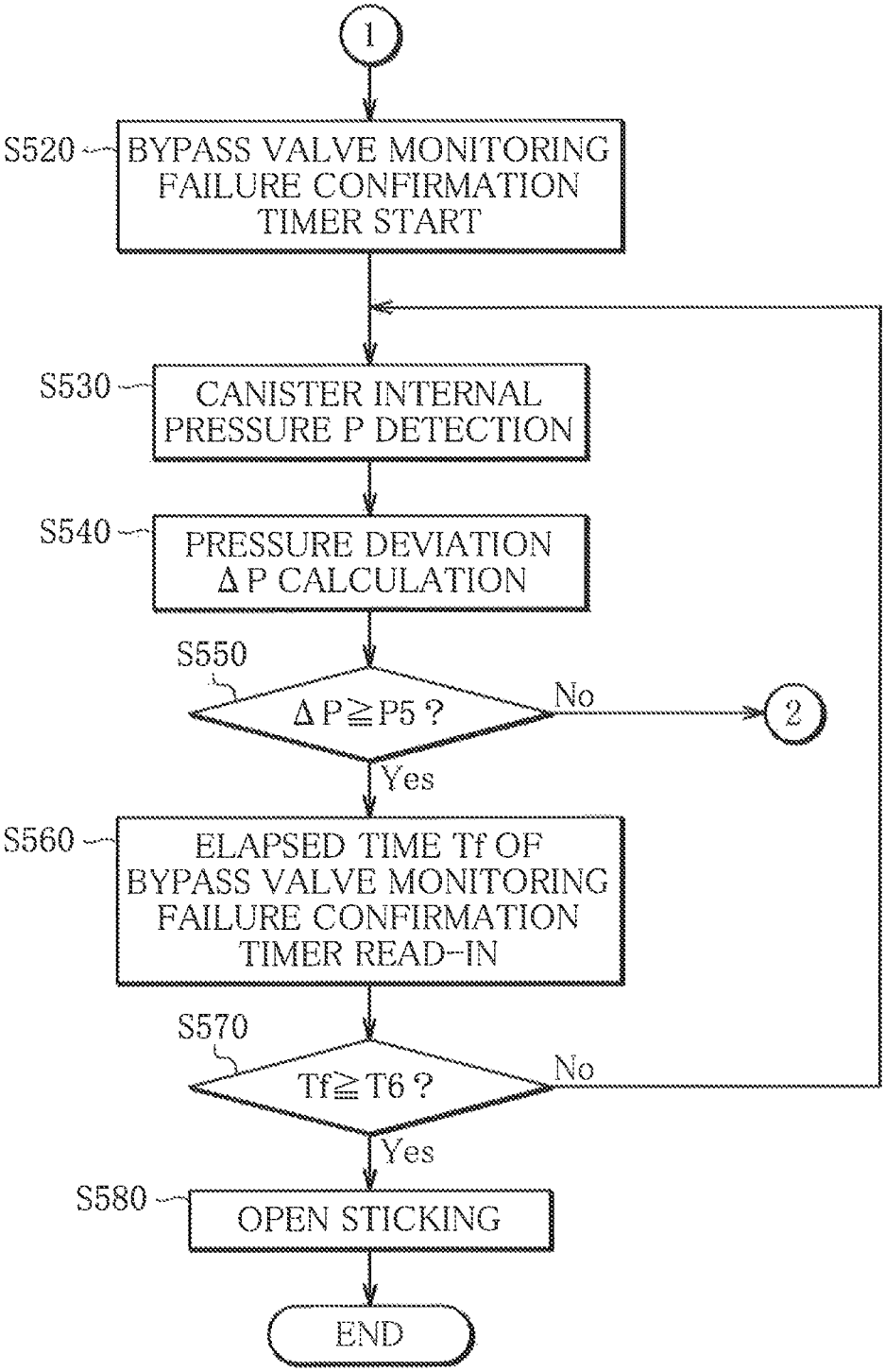
FIG. 16 is the rest of the control flowchart of sticking determination control of a bypass valve, which is executed by the electronic control unit of the third embodiment of the present invention.
Figure 17:
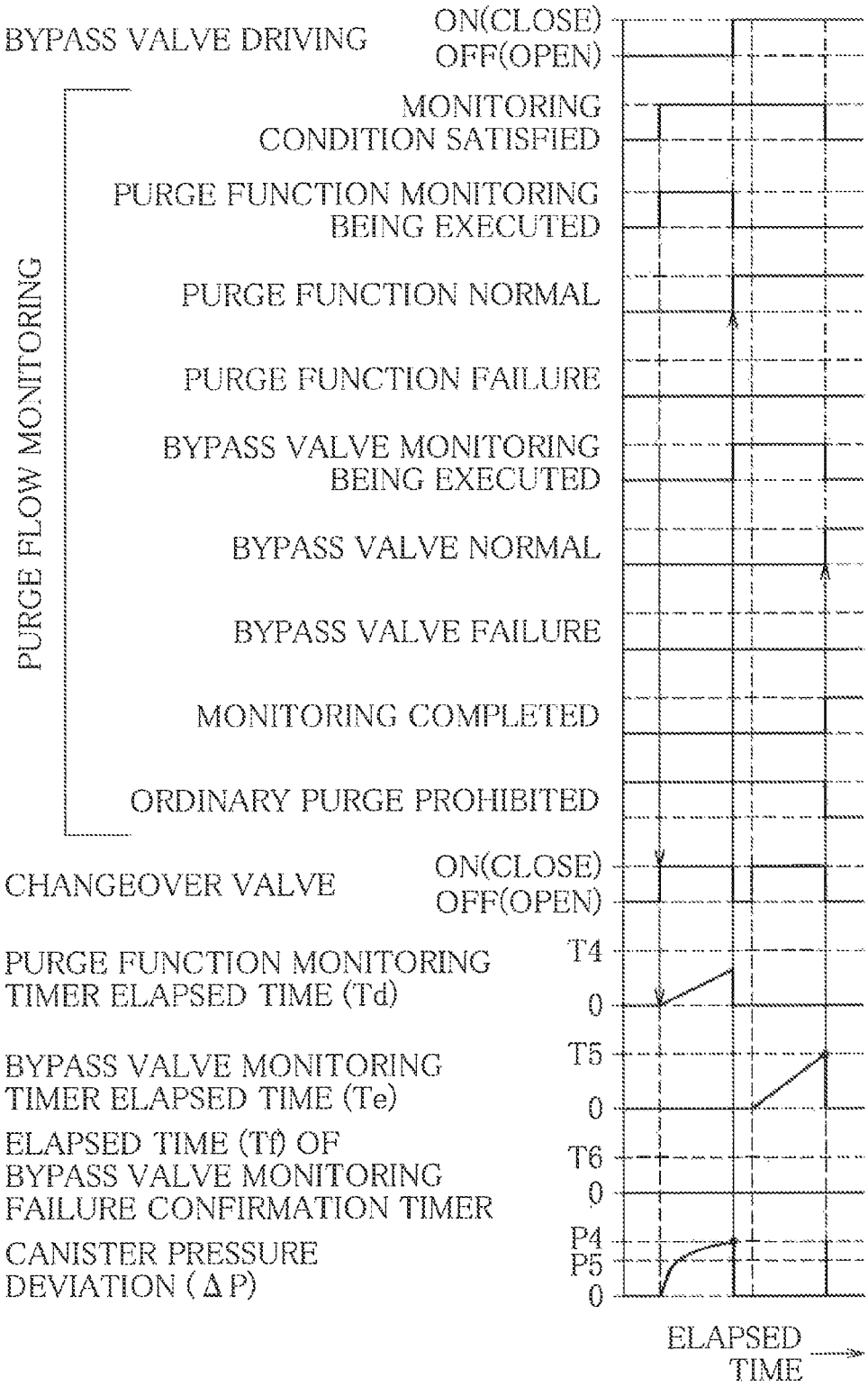
FIG. 17 is a time chart to show an example of transitions of a driving signal of a bypass valve, operations of each valve and each timer, and canister pressure deviation when it is determined that there is no open sticking in the electronic control unit of the third embodiment.
Figure 18:
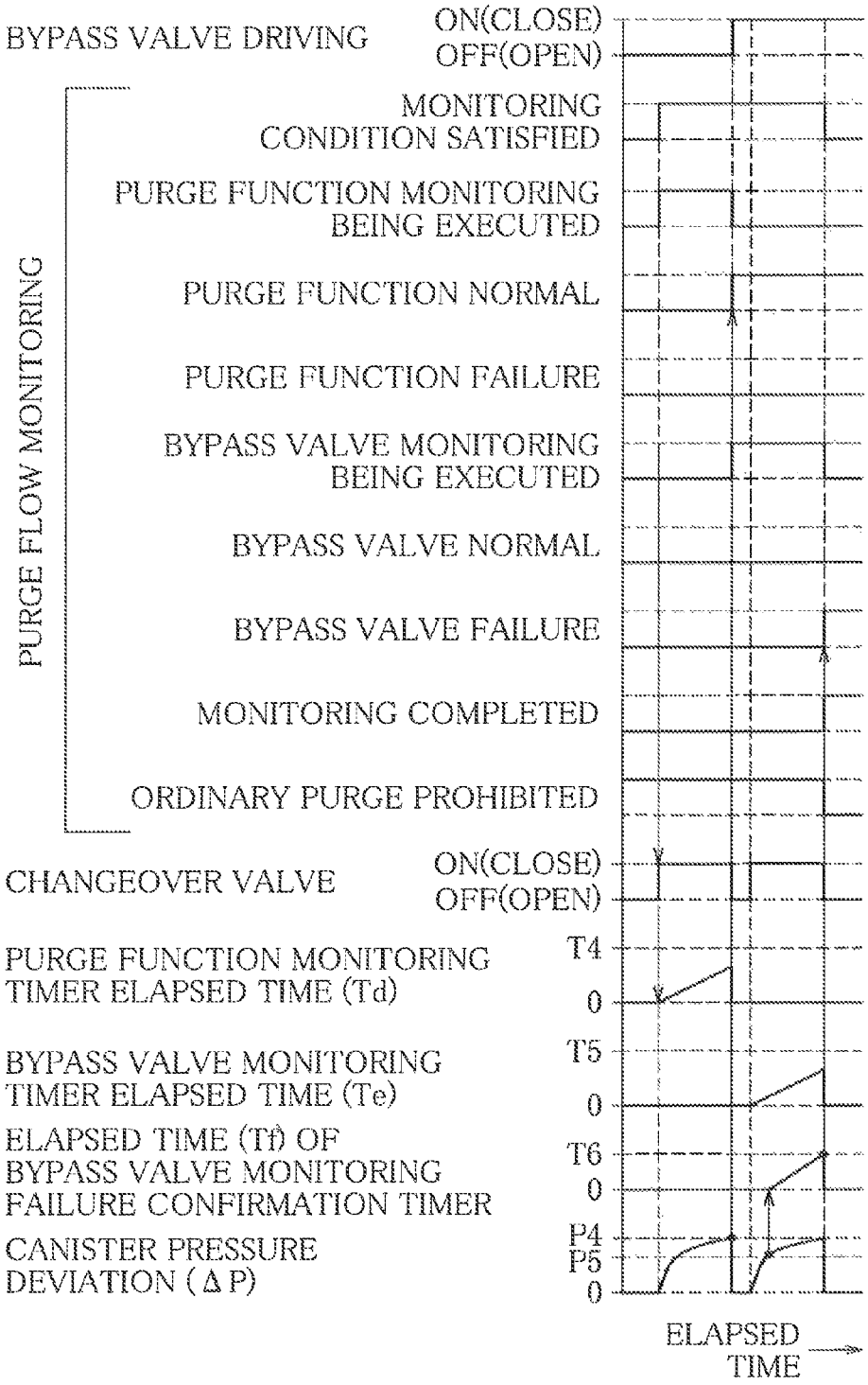
FIG. 18 is a time chart to show an example of transitions of a driving signal of a bypass valve, operations of each valve and each timer, and canister pressure deviation when determined that there is open sticking in the electronic control unit of the third embodiment.

FIG. 15 is a part of a control flowchart of purge flow monitoring and open sticking determination control of the bypass valve 37, which are executed by the electronic control unit 42, and FIG. 16 is the rest thereof. Moreover, each of FIGS. 17 and 18 is a time chart to show transitions of a driving signal of the bypass valve 37, operations of the changeover valve 34*e*, each timer (a purge function monitoring timer, a bypass valve monitoring timer, a bypass valve monitoring failure confirmation timer), and canister pressure deviation, and each determination signal in the purge flow monitoring and the open sticking determination control of the bypass valve 37. FIG. 17 shows that the purge function is normal, and also the bypass valve 37 is normal. FIG. 18 shows an example in which it is determined that the purge function is normal, and there is open sticking in the bypass valve 37.

The purge flow monitoring and the open sticking determination control of the bypass valve 37 are carried out when the engine is in operation.

As shown in FIGS. 15 and 16, firstly the purge flow monitoring is carried out in step S410. The purge flow monitoring determines a failure of the purge function based on change in the canister internal pressure P which is detected by the pressure sensor 34*h* with the changeover valve 34*e* being closed and the purge valve 36 being opened when the engine is in operation, as with a purge flow detection portion described in Japanese Patent No. 4352945. When performing the purge flow monitoring, the bypass valve 37 is controlled to be opened. The purge flow monitoring is started by opening of the changeover valve 34*e*. At the time of the closing of the changeover valve 34*e*, the canister internal pressure is detected with the pressure sensor 34*h* and is stored as a reference pressure Pb, and a purge function monitoring timer is started from 0.

Then, if a canister pressure deviation ΔP (=|P−Pb|), which is the difference between the canister internal pressure P and the reference pressure Pb, becomes not less than a predetermined pressure P4 before a time period Td measured by the purge function monitoring timer reaches a predetermined time period T4, it is determined that the purge function is normal, and if the canister pressure deviation ΔP does not reach the predetermined pressure P4 even when the time period reaches the predetermined time period T4, it is determined that the purge function is abnormal.

It is noted regarding the predetermined time period T4 and the predetermined pressure P4, the predetermined pressure P4 may be set to around a lower limit value of the amount of pressure decrease (absolute value) in the canister 33 when the predetermined time period T4 has elapsed, which is confirmed when the purge function is normal. Then the process proceeds to step S420.

In step S420, if it has been determined that the purge function is normal in step S410, the process proceeds to step S430. If it has been determined that the purge function is abnormal, the present routine is ended.

In step S430, the bypass valve 37 is controlled to be closed, and the changeover valve 34*e* is opened for a predetermined time period. The predetermined time period may be set to around a time period in which the pressure in the canister 33 is released to the atmospheric pressure. Then, the process proceeds to step S440.

In step S440, the changeover valve 34*e* is controlled to be closed. Then, the process proceeds to step S450.

In step S450, canister internal pressure is detected with the pressure sensor 34*h*, and the detected pressure is stored as a reference pressure Pb. Further, a bypass valve monitoring timer is started from 0. Then, the process proceeds to step S460.

In step S460, canister internal pressure P is detected by the pressure sensor 34*h*. Then, the process proceeds to step S470.

In step S470, pressure deviation ΔP (=|P−Pb|) which is the difference between the canister internal pressure P detected in step S460 and the reference pressure Pb stored in step S450 is calculated. Then, the process proceeds to step S480.

In step S480, it is determined whether or not the pressure deviation ΔP calculated in step S470 is not less than a fifth predetermined pressure P5. It is noted that when the bypass valve 37 is in an open state, the fifth predetermined pressure P5 may be set to around a lower limit value of the pressure deviation, which is produced in a predetermined time period T5 which is appropriately set, as a result of the canister internal pressure being decreased due to negative pressure in the purge pipe 31 after purge flow monitoring, and which is measured in advance through experiment, etc. If the pressure deviation ΔP is not less than the fifth predetermined pressure P5, the process proceeds to step S520 in FIG. 16. If the pressure deviation ΔP is less than the fifth predetermined value P5, the process proceeds to step S490.

In step S490, an elapsed time Te since the bypass valve monitoring timer is started in step S450 is read in. Then, the process proceeds to step S500.

In step S500, it is determined whether or not the elapsed time Te read in in step S490 is not less than the fifth predetermined time period T5. If the elapsed time Te is not less than the fifth predetermined time period T5, the process proceeds to step S510. If the elapsed time Te is less than the fifth predetermined time period T5, the process returns to step S460.

In step S510, it is determined that there is no open sticking in the bypass valve 37. Then, the present routine is ended.

In step S520 in FIG. 16, a bypass valve failure confirmation timer is started from 0. Then, the process proceeds to step S530.

In step S530, canister internal pressure P is detected by the pressure sensor 34*h*. Then, the process proceeds to step S540.

In step S540, pressure deviation ΔP (=|P−Pb|) which is the difference between the canister internal pressure P detected in step S530 and the reference pressure Pb stored in step S450 is calculated. Then, the process proceeds to step S550.

In step S550, it is determined whether or not the pressure deviation ΔP calculated in step S540 is not less than the fifth predetermined pressure P5. The fifth predetermined pressure P5 may be set to a value slightly lower than the fourth predetermined pressure P4. If the pressure deviation ΔP is not less than the fifth predetermined pressure P5, the process proceeds to step S560. If the pressure deviation ΔP is less than the fifth predetermined pressure P5, the process returns to step S460 in FIG. 15.

In step S560, an elapsed time Tf since the bypass valve failure confirmation timer is started in step S520 is read in. Then, the process proceeds to step S570.

In step S570, it is determined whether or not the elapsed time Tf read in in step S560 is not less than a sixth predetermined time period T6. If the elapsed time Tf is not less than the sixth predetermined time period T6, the process proceeds to step S580. If the elapsed time Tf is less than the sixth predetermined time period T6, the process returns to step S530.

In step S580, it is determined that there is open sticking in the bypass valve 37. Then, the present routine is ended.

It is noted that the above described control according to step S410 by the electronic control unit 42 corresponds to the purge function determiner of the present invention, and the control according to steps S420 to S580 by the electronic control unit 42 corresponds to the canister opening/closing valve abnormality detector of the present invention.

Hereafter, open sticking determination control of the bypass valve 37 in the electronic control unit 42 relating to the third embodiment configured as described above will be described. The open sticking determination control of the bypass valve 37 is performed following the purge flow monitoring (step S410) when the engine is in operation.

If it is determined that the purge function is normal by the purge flow monitoring, the bypass valve 37 is controlled to be closed, and the changeover valve 34*e* is temporarily opened to release the canister internal pressure to the atmosphere.

At this moment, inside the purge pipe 31 is under negative pressure as a result of the purge flow monitoring. Then, if the bypass valve 37 is actually in a closed state, the pressure in the canister 33 is maintained at the atmospheric pressure. If the bypass valve 37 is actually in an open state, the pressure in the canister 33 decreases from the atmospheric pressure under the influence of negative pressure of the purge pipe 31 and the intake passage 11.

Therefore, if the pressure deviation ΔP becomes not less than the fifth predetermined pressure P5 even if the predetermined time period T5 has elapsed since the changeover valve 34*e* is closed, it can be determined that the bypass valve 37 is actually in a closed state, and not in an open sticking state.

If a state in which the pressure deviation ΔP has increased and the pressure deviation ΔP becomes not less than the fifth predetermined pressure P5 lasts for a predetermined time period T6, since it is inferred that the pressure in the canister 33 has decreased under the influence of negative pressure of the purge pipe 31 and the intake passage 11 in spite of that the bypass valve 37 is controlled to be closed, it can be determined that the bypass valve 37 is in an open sticking state.

Here, the reason why it is determined that the bypass valve 37 is in an open sticking state based on the fact that pressure not less than the fifth predetermined pressure P5 has lasted for the predetermined time period T6, rather than determining that the bypass valve 37 is in an open sticking state when the pressure deviation ΔP becomes not less than the fifth predetermined pressure P5 is for restricting the effect of variation in intake pressure caused by engine operation.

In this way, as a result of that the purge flow monitoring determines that the purge function is normal, it becomes possible, by taking advantage of the state that inside the purge pipe 31 is under negative pressure, to determine open sticking of the bypass valve 37 by controlling the bypass valve 37 to be closed and based on the change of pressure in the canister.

Moreover, since open sticking determination control of the bypass valve 37 is carried out following that the purge flow monitoring determines that the purge function is normal, it is possible to carry out abnormality detection of the purge flow monitoring and the bypass valve 37 in a short period of time.

Moreover, since the determination of open sticking of the bypass valve 37 is performed based on the detection result of the pressure sensor 34*h* alone, it is possible to reduce the possibility that determination is disabled due to failure of the pressure sensor, rather than when the determination of open sticking and closed sticking of the bypass valve 37 is performed based on detection results of a plurality of pressure sensors.

Although description of inventive embodiments has been completed so far, the modes of the present invention will not be limited to the above described embodiments.

For example, in the above described first embodiment or second embodiment, only either one of the above described open sticking determination control and closed sticking detection control may be carried out.

Moreover, in the above described first embodiment, open sticking determination and closed sticking determination are possible not only when the engine is stopped by a key-off, but also are possible provided that the intake passage 11 is under near the atmospheric pressure.

Moreover, although the negative pressure pump 34*c* is provided for the evaporative leak check module 34 in the above described first and second embodiments, a positive pressure pump that generates positive pressure may be used in place thereof.

Further, although the vehicle has been supposed to be a hybrid vehicle in the above described embodiments, this is not limiting, and it is possible to detect abnormalities such as open sticking and closed sticking of the bypass valve 37 widely in a fuel evaporative gas emission suppression system having a bypass valve 37, which has a pressure pump capable of applying pressure to inside the canister 33, and a pressure sensor for detecting pressure in the canister 33. Moreover, it is possible to detect open sticking of the bypass valve 37 widely in fuel evaporative gas emission suppression systems having a bypass valve 37 and capable of purge flow monitoring.

What is claimed is:

1. A fuel evaporative gas emission suppression system, comprising:

a communication path configured to communicate between an intake passage and a fuel tank of an internal combustion engine;

a canister connected to the communication path and that adsorbs fuel evaporative gas in the communication path;

a canister opening/closing valve configured to open and close communication between the communication path and the canister;

a purge valve configured to open and close the communication path between the intake passage and the canister;

a pressure generator configured to generate pressure in the canister via a communication hole that communicates between inside and outside of the canister;

a pressure detector configured to detect internal pressure of the canister; and a control unit that, when the internal combustion engine is in a stopped state, turns the purge valve into an open state, actuates the pressure generator, and controls the canister opening/closing valve to be opened/closed, and performs abnormality detection control of the canister opening/closing valve based on a change of the internal pressure of the canister detected by the pressure detector.

2. The fuel evaporative gas emission suppression system according to claim 1, wherein the control unit controls the canister opening/closing valve to be closed in a state that the purge valve is opened and the pressure generator is actuated when the internal combustion engine is stopped, and determines that the canister opening/closing valve is in an open sticking state if the internal pressure of the canister detected by the pressure detector does not change by not less than a first predetermined pressure.

3. The fuel evaporative gas emission suppression system according to claim 1, wherein the control unit controls the canister opening/closing valve to be opened when there is difference between pressures in the canister and in the communication path, and determines that the canister opening/closing valve is in a closed sticking state if the internal pressure of the canister detected by the pressure detector does not change by not less than a second predetermined pressure.

4. The fuel evaporative gas emission suppression system according to claim 2, wherein the control unit further controls the canister opening/closing valve to be opened when there is difference between pressures in the canister and in the communication path, and determines that the canister opening/closing valve is in a closed sticking state if the internal pressure of the canister detected by the pressure detector does not change by not less than a second predetermined pressure.

5. The fuel evaporative gas emission suppression system according to claim 1, further comprising:

a tank opening/closing valve configured to open and close the communication path between the fuel tank and the canister, wherein the control unit further makes the tank opening/closing valve be closed when performing the abnormality detection control.

6. A fuel evaporative gas emission suppression system, comprising:

a communication path configured to communicate between an intake passage and a fuel tank of an internal combustion engine;

a canister connected to the communication path and that adsorbs fuel evaporative gas in the communication path;

a canister opening/closing valve configured to open and close communication between the canister and the communication path;

a purge valve configured to open and close the communication path between the intake passage and the canister;

a pressure generator configured to generate pressure in the canister via a communication hole that communicates between inside and outside of the canister;

a pressure detector configured to detect internal pressure of the canister; and a control unit that turns the purge valve into a closed state, actuates the pressure generator, and controls the canister opening/closing valve to be opened/closed, and performs abnormality detection control of the canister opening/closing valve based on a change rate of the internal pressure of the canister detected by the pressure detector.

7. The fuel evaporative gas emission suppression system according to claim 6, wherein the control unit turns the purge valve into a closed state, actuates the pressure generator, and determines that the canister opening/closing valve is in an open sticking state if the internal pressure of the canister detected by the pressure detector does not change by not less than a first predetermined pressure before a first predetermined time period elapses since the canister opening/closing valve is controlled to be closed.

8. The fuel evaporative gas emission suppression system according to claim 6, wherein the control unit determines that the canister opening/closing valve is in a closed sticking state if the internal pressure of the canister detected by the pressure detector changes by not less than a second predetermined pressure before a second predetermined time period elapses since the pressure generator is actuated in a state that the purge valve is closed and the canister opening/closing valve is opened.

9. The fuel evaporative gas emission suppression system according to claim 6, further comprising:

a tank opening/closing valve configured to open and close the communication path between the fuel tank and the canister, wherein the control unit further makes the tank opening/closing valve be closed at the time of the abnormality detection control.

10. A fuel evaporative gas emission suppression system, comprising:

a communication path configured to communicate between an intake passage and a fuel tank of an internal combustion engine;

a canister connected to the communication path and that adsorbs fuel evaporative gas in the communication path;

a canister opening/closing valve configured to open and close communication between the communication path and the canister;

a purge valve configured to open and close the communication path between the intake passage and the canister;

a pressure detector configured to detect internal pressure of the canister;

a purge function determiner that opens the purge valve and the canister opening/closing valve while the internal combustion engine is operated, and determines if a purge function of the canister is normal based on a change in the internal pressure of the canister detected by the pressure detector; and a canister opening/closing valve abnormality detector configured to perform abnormality detection of the canister opening/closing valve based on the determination by the purge function.

11. The fuel evaporative gas emission suppression system according to claim 10, wherein the canister opening/closing valve abnormality detector performs abnormality detection of the canister opening/closing valve when the purge function determiner determines that the purge function is normal.

12. The fuel evaporative gas emission suppression system according to claim 11, wherein the canister opening/closing valve abnormality detector performs abnormality detection of the canister opening/closing valve based on a change in the internal pressure of the canister detected by the pressure detector after the canister opening/closing valve is closed when the purge function determiner determines that the purge function is normal.

13. The fuel evaporative gas emission suppression system according to claim 12, wherein the canister opening/closing valve abnormality detector controls the canister opening/closing valve to be closed in a state that the purge function is determined to be normal and the communication path is under negative pressure, and determines that the canister opening/closing valve is in an open sticking state if the internal pressure of the canister detected by the pressure detector decreases by not less than a predetermined value since the canister is temporarily released to the atmosphere.

14. The fuel evaporative gas emission suppression system according to claim 13, further comprising:

an open/close changeover valve configured to open and close the communication between the canister and ambient air, wherein the canister opening/closing valve abnormality detector temporarily releases inside of the canister to the atmosphere by temporarily opening the open/close changeover valve.

* * * * *